United States Patent [19]

Morgan et al.

[11] Patent Number: 4,914,434

[45] Date of Patent: Apr. 3, 1990

[54] TRAFFIC SIGNAL PREEMPTION SYSTEM

[76] Inventors: Rodney K. Morgan, P.O. Box 94, Belle Rive, Jefferson County, Ill. 62810; Bradley K. Cross, P.O. Box 152, McLeansboro, Hamilton County, Ill. 62859

[21] Appl. No.: 206,172

[22] Filed: Jun. 13, 1988

[51] Int. Cl.[4] ..... G08G 1/07

[52] U.S. Cl. ..... 340/906; 340/902; 340/907

[58] Field of Search ..... 340/906, 907, 902, 916, 340/933, 935, 904; 455/99, 95, 67, 134

[56] References Cited

U.S. PATENT DOCUMENTS

| | | | |
|---|---|---|---|
| 3,257,641 | 6/1966 | Campana et al. | 340/33 |
| 3,638,179 | 1/1972 | Coll et al. | 340/32 |
| 3,886,515 | 5/1975 | Cottin et al. | 340/906 |
| 4,016,532 | 4/1977 | Rose | 340/906 |
| 4,228,419 | 10/1980 | Anderson | 340/32 |
| 4,230,992 | 10/1980 | Munkberg | 328/140 |
| 4,443,783 | 4/1984 | Mitchell | 340/32 |
| 4,573,049 | 2/1986 | Obeck | 340/906 |

FOREIGN PATENT DOCUMENTS

| | | | |
|---|---|---|---|
| 1315525 | 5/1973 | United Kingdom | 340/906 |

*Primary Examiner*—Donnie L. Crosland

*Attorney, Agent, or Firm*—Fitch, Even, Tabin & Flannery

[57] ABSTRACT

When placed into operation by the occupants of an emergency vehicle, a vehicle transmission system having a directional antenna sends out a series of UHF messages spaced apart by varying lengths of time and identifying the emergency vehicle, its priority, and its direction, or indicating that the vehicle is travelling along a pre-planned route. At each signal-controlled intersection, a vehicle detection, identification, and preemption system having an omnidirectional antenna and containing information identifying vehicles authorized to preempt the intersection and their pre-planned directions of travel receives these messages from plural vehicles and determines when and in favor of which direction and for how long the intersection is to be preempted.

28 Claims, 18 Drawing Sheets

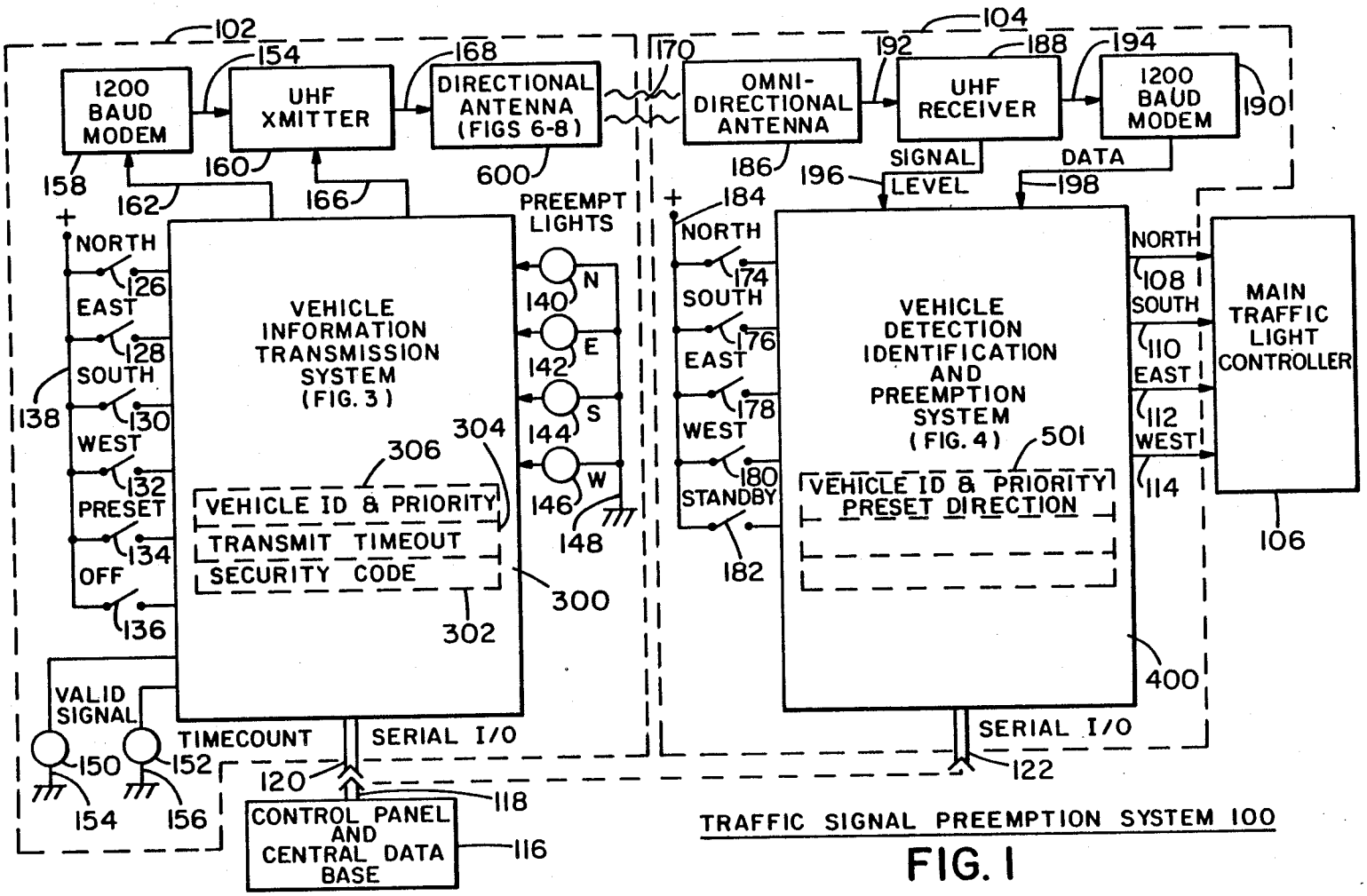
MAIN TRAFFIC LIGHT CONTROLLER
106
NORTH
108
SOUTH
110
EAST
112
WEST
114
400
VEHICLE DETECTION IDENTIFICATION AND PREEMPTION SYSTEM (FIG. 4)
501
VEHICLE ID & PRIORITY
PRESET DIRECTION
SERIAL I/O
122
1200 BAUD MODEM
190
194
DATA
198
UHF RECEIVER
188
104
192
SIGNAL LEVEL
196
OMNI-DIRECTIONAL ANTENNA
186
170
NORTH
184
SOUTH
174
EAST
176
WEST
178
STANDBY
180
182
TRAFFIC SIGNAL PREEMPTION SYSTEM 100
FIG. 1
DIRECTIONAL ANTENNA (FIGS 6-8)
168
600
PREEMPT LIGHTS
N
140
E
142
S
144
W
146
148
300
304
VEHICLE INFORMATION TRANSMISSION SYSTEM (FIG. 3)
306
VEHICLE ID & PRIORITY
TRANSMIT TIMEOUT
SECURITY CODE
302
SERIAL I/O
118
116
CONTROL PANEL AND CENTRAL DATA BASE
UHF XMITTER
154
166
160
102
1200 BAUD MODEM
158
162
NORTH
126
EAST
128
SOUTH
130
WEST
132
PRESET
134
OFF
136
138
TIMECOUNT
152
156
VALID SIGNAL
150
154
120

VEHICLE INFORMATION TRANSMISSION SYSTEM 300

PREEMPTION SYSTEM PARAMETERS 496

TRAFFIC SIGNAL PREEMPTION SYSTEM

FIELD OF THE INVENTION

This invention relates to traffic control systems, and more particularly to systems that enable an emergency vehicle to preempt the normal operation of traffic signals which the vehicle approaches, forcing them to turn green for the emergency vehicle and red for other directions, or red for all directions.

BACKGROUND

U.S. Pat. No. 3,257,641 issued to Patsy C. Campana and Thomas T. Chrysler on June 21, 1966 teaches the idea of equipping an emergency vehicle with a radio transmitter which, when actuated by the vehicle's occupants, causes the intersection's traffic control system to preempt the traffic signals at the intersection. The Campana patent proposes the use of a 255 megacycle, tone modulated transmitter in the emergency vehicle. When the vehicle's occupants press a pushbutton, this transmitter sends out a radio signal modulated with an audio tone. A receiver mounted on the traffic light, in response to receipt of the proper frequency and tone combination, causes a preemption controller unit to preempt the traffic signals at the intersection by forcing the intersection's traffic control system to present red signals in all directions.

The Campana patent proposes utilizing multiple tones in the transmitter to enable an emergency vehicle to control several functions, and U.S. Pat. No. 3,638,179 issued to Edward T. Coll et al. on Jan. 25, 1972 discloses such a system. The occupant of the vehicle sets a switch to indicate the direction of travel, and that switch selects a tone which corresponds to the direction selected. A radio signal modulated with the selected tone is then produced. A receiver mounted on the traffic light responds differently to different tones, causing the traffic control system at an intersection to present a green light in the direction of the approaching emergency vehicle and a red light in all other directions. U.S. Pat. No. 4,443,783 issued to Wilbur L. Mitchell on Apr. 17, 1984 discloses a transmitter that modulates with dual tones and thus provides improved noise and invalid (or counterfeit) signal immunity.

An improved preemption system is disclosed in U.S. Pat. No. 4,228,419 issued to George P. Anderson on Oct. 14, 1980. Here, a directional transmitter on the emergency vehicle actually sends a message byte (to number) to the receiver at each intersection. One particular message byte (or number) informs the receiver that the vehicle's siren and warning lights are in operation, and the receiver responds by preempting the intersection for a fixed, predetermined length of time. Another particular message byte (or number) informs the receiver that the vehicle's occupants have actuated a manual preemption switch, and the receiver responds by preempting the intersection for as long as the manual switch remains actuated. So two distinct preemption functions are possible. The patent teaches that other distinct functions may be selected by having the occupant of the vehicle depress one or more keys on a keyboard. This patent teaches that a unique code can be assigned to each vehicle and transmitted so that the receiver at each intersection can forward to police headquarters the identity of the signalling vehicle and its location. This patent teaches that the direction of emergency vehicle travel can be determined through the use of multiple directional receiving antennas, one for each possible emergency vehicle approach direction, with each directional receiving antenna having its own receiver, demodulator, and message byte decoder. At a four-way intersection, assumedly four receivers, demodulators, and decoders would be required.

Optical transmitters have been utilized in the design of preemption systems. U.S. Pat. No. 4,230,992 issued to John A. Munkberg on Oct. 28, 1980, for example, discloses a system utilizing separate north-south and east-west optical signal receivers designed to receive optical pulses whose energy content exceeds a predetermined threshold level, rejecting all pulses not generated at one of two predetermined, precise pulse repetition rates. This patent also teaches the use of first and second optical pulse repetition rates to signal respectively lower and higher priority vehicles, and it discloses a mechanism that preempts an intersection in favor of the higher-priority vehicle when two vehicles having different priorities approach the intersection simultaneously from different directions.

Optical systems such as that just described are highly directional—light cannot flow around trucks, trees, and other such obstacles. Weather conditions such as fog can interfere with the operation of an optical system.

All of the above systems initiate a preemption in response to the receipt of a standard signal selected from a small set of valid preemption signals which are the same for all the emergency vehicles within a given city. If a transmitter is stolen, there is no simple way to cause intersections to ignore the preemption signals from that one stolen transmitter without also causing them to ignore the preemption signals from all the other transmitters in the city.

Except through the use of multiple directional receivers, these systems are unable to process multiple signals receive simultaneously from multiple vehicles and to select intelligently which vehicle should gain preemption. These systems cannot utilize a single omni-directional receiving antenna without the possibility that one signal will drown out another or the two signals will interfere with each other and prevent either from being received.

These systems also determine the direction from which an emergency vehicle approaches an intersection only through the use of multiple directional receiving antennas or, if a single omni-directional antenna is used, through manual depression of a directional pushbutton by the vehicle's occupants. There is no way in which the direction of emergency vehicle travel can be determined fully automatically except through the use of multiple directional receiving antennas or actuation of manual switches by vehicle occupants at each intersection.

SUMMARY OF THE INVENTION

Briefly described, the present invention equips each emergency vehicle with a vehicle information transmission system. This system includes a directional, forward-facing UHF antenna that is fed by a transmitter which operates at a UHF frequency low enough to permit the signals to flow around trucks and tree limbs but high enough to permit the antenna to be both compact and also sufficiently directional to prevent the occurrence of accidental preemption through radiation down side streets. The invention equips each intersection with a vehicle detection, identification, and preemption system. This system includes a single receiving antenna mounted on or near a traffic light or traffic light controller which receives signals from all directions.

Rather than having the emergency vehicle transmit a continuous signal, the present invention has the emergency vehicle transmit the same message repeatedly at periodic intervals. The time duration between successive transmissions is varied (made longer and shorter). The use of periodic transmissions separated by extended nontransmission intervals enables periodic transmissions to be receive from several vehicles as they approach the same intersection so long as the transmissions are not simultaneous. If simultaneous transmission from two emergency vehicles do interfere with each other, the transmitter mechanism that varies the time duration between successive transmissions insures that subsequent transmissions by the same two vehicles are not simultaneous and do not interfere with one another. Interference attributable to simultaneous transmission is thus minimal and does not impair the ability of the present invention to identify the vehicles approaching an intersection and to determined, based upon preprogrammed preemption criteria, when an in favor of which vehicle and direction and for how long to preempt an intersection.

The information transmitted by an emergency vehicle includes information identifying the specific vehicle that is requesting preemption, vehicle priority information, and directional information. The directional information can take two different forms. If the occupants of a vehicle manually signal a particular direction of approach to an intersection, then the directional information simply identifies the direction of approach. But if the occupants of a vehicle manually signal that the vehicle is proceeding along a preplanned route, as is customary with fire engines and many other emergency vehicles, then the direction information so indicates, and the vehicle detection, identification, and preemption system which receives the information retrieves the preplanned direction of approach from pre-stored data that associates at least on preplanned direction of approach with each vehicle's identification information at each intersection.

Within the vehicle detection, identification, and preemption system at each intersection, pre-stored data contains the vehicle identification information for all the vehicles that are authorized to preempt that particular intersection. The system at each intersection is therefore able to verify whether a particular vehicle is authorized to preempt the intersection, and it can prevent preemption if a vehicle does not have authority to preempt the intersection. The pre-stored data also associated at least one preplanned direction of travel with the identification information for each vehicle. In response to a vehicle signalling that it is following a preplanned route of travel, and by referring to this pre-stored data, the system at each intersection can determine from which direction the vehicle is approaching the intersection and can then preempt the intersection in favor of the preplanned direction of travel. Accordingly, the vehicle occupants do not need to signal the actual direction of approach to each intersection, and multiple directional receiving antennas are not required at teach intersection to determine a vehicle's direction of approach.

Both the information transmission system installed in each vehicle and the vehicle detection, identification, and preemption system installed at each intersection include provision for maintaining a log of all preemption events. The log includes the vehicle identification information, the direction of travel, the time duration of the preemption, and the time and date. A portable computer programmed to function as a control panel and data base is used to gather this preemption log from each vehicle and from each intersection. The same computer can also be used to examine and to alter the information that is stored within each vehicle's information transmission system and within the vehicle detection, identification, and preemption system at each intersection. The vehicle identification information and priority assigned to each vehicle can thus be changed. And at each intersection, invalid vehicle identification information can be deleted, new vehicle identification information can be added, and preplanned route information for any vehicle can be modified. The assigned vehicle identification information and priority information effectively function as passwords assigned to each vehicle which given excellent immunity against accidental preemptions and preemptions triggered by counterfeit transmitters.

These and other aspects, objects and advantages of the present invention will be made more evident from the following detailed description, particularly when taken in conjunction with the accompanying drawings.

DESCRIPTION OF THE DRAWINGS

FIG. 1 is an overview block diagram of a traffic signal preemption system 100 designed in accordance with the teachings of the present invention;

DETAILED DESCRIPTION

Figure 2:
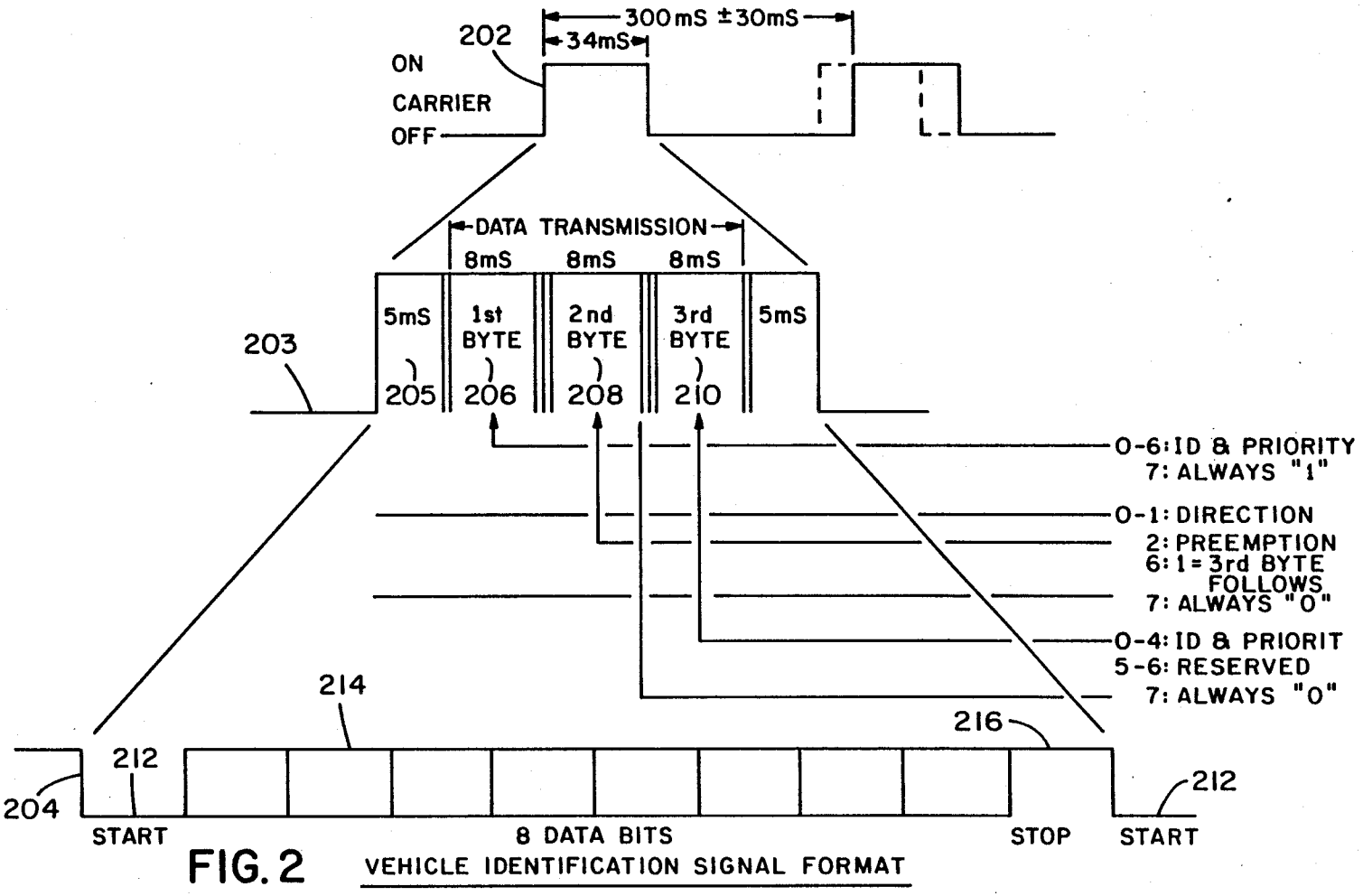
FIG. 2 is a timing diagram illustrating the details of the vehicle identification signal generated by the vehicular unit 102 in FIG. 1.

Referring now to the drawings, FIG. 1 is a block diagram of a traffic signal preemption system 100 designed in accordance with the present invention. The preemption system 100 includes any number of vehicular units 102 which are designed for installation in a police car, a fire truck, an ambulance, or some other emergency vehicle that needs on occasion to preempt the normal operation of traffic signal. The system 100 also includes traffic controller units 104 which are designed to be integrated into the traffic control system at intersections and to respond to signals emanated by the vehicular units 102 by sending preemption signals north 108, south 110, east 112, or west 114 or their equivalent to the main traffic light controller 106 which controls the operation of an intersection. Presently, the invention also contemplates the use of a control panel and central database 116 having a serial I/O connector 118 which may be connected to serial I/O connectors 120 and 122 associated with the vehicular unit 1021 and the traffic control unit 104 and which may be used to reprogram and to accept log data from the units 102 and 104, as will be explained.

Figure 3:
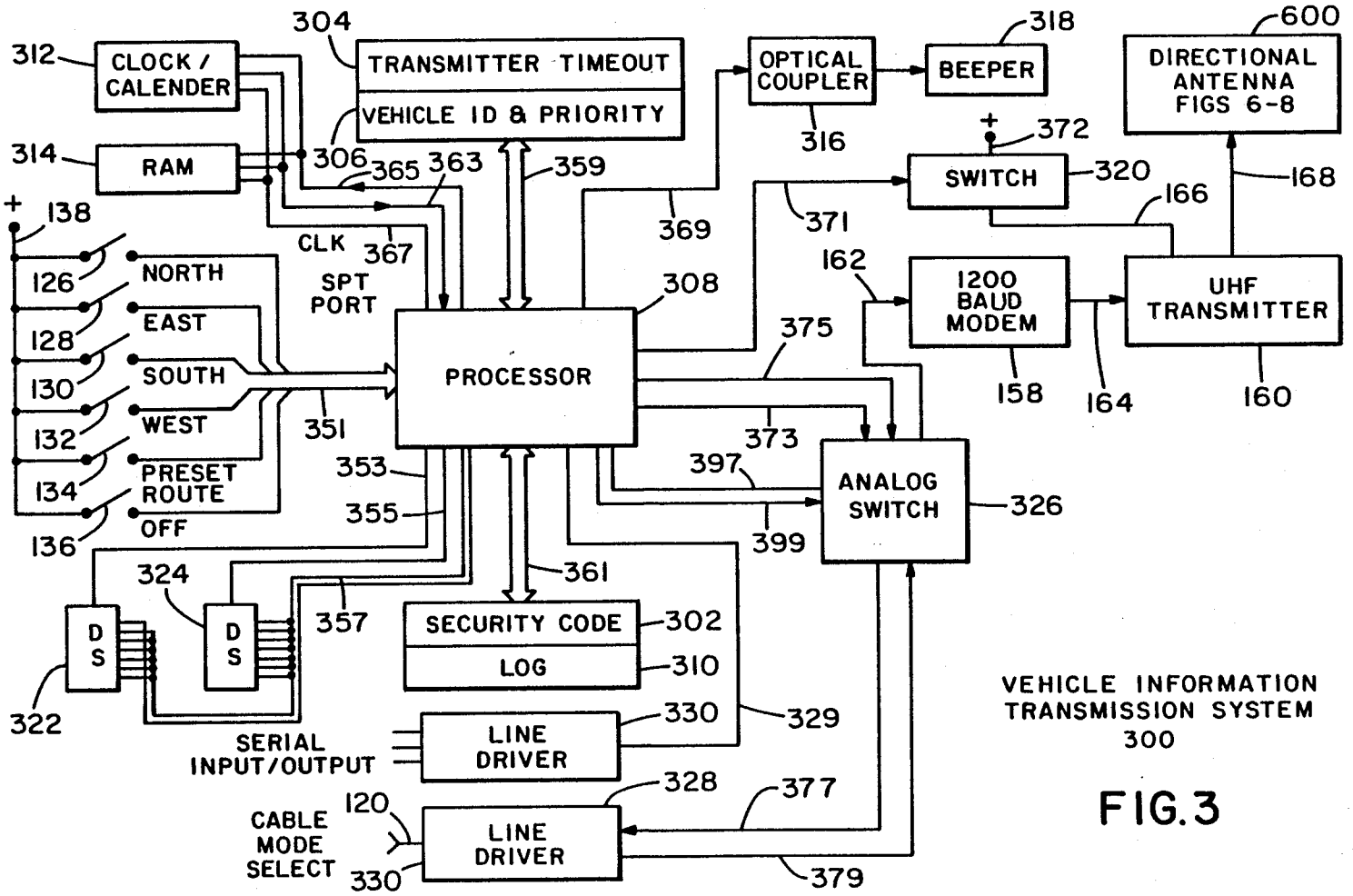
FIG. 3 is partly block, partly schematic diagram of the vehicle information transmission system 300.

The heart of the vehicular unit 102 is a vehicle information transmission system 300 the details of which are shown in FIG. 3. The system 300 has connected to it a series of push buttons labeled north 126, east 128, south 130, west 132, preset 134, and off 136. The push buttons 126 to 136 are mounted on the dashboard of the emergency vehicle where they may be accessed by occupants of the vehicle. In addition, preemption lights labeled N 140, E 142, S 144, and W 146 also appear on the vehicular dashboard and are connected between the vehicle transmission system 300 and a source of ground potential 148. Stored within the vehicle transmission system 300 are a vehicle I.D. and priority 306 that identifies a unique vehicle its priority for preempting an intersection over other vehicles, a transmit timeout 304 which specifies how long a preemption should continue if not stopped earlier by actuation of the push button 136, and a security code 302 which must be typed in by the occupants of the vehicle using the push buttons 126 through 136 to initiate a preemption operation. Variables 302 through 306 may be altered by means of the control panel and central database 116, which is actually a portable IBM-compatible personal computer programmed to provide communication between an operator and the vehicle information transmission system 300 at times when the variables 302 through 306 are to be altered or when logged data is to be collected.

The vehicle information transmission system 300 also provides energizing power to a valid signal light 150 and to a timeout light 152 which respectively connect to ground potential at 154 and 156.

The vehicular unit 102 also includes a 1200 Baud modem 158 which receives information to be transmitted in digital form from the vehicle information transmission system 300 over a signal line 162. The modem 158 provides a 1200 Baud modulated tone signal over a signal line 154 to a UHF transmitter 160 that is preferably tuned to somewhere within the range of 400 to 1000 megacycles—450 megacycles in the preferred embodiment of the invention. This range of frequencies has been found to be optimal for providing the necessary directivity to prevent accidental preemption of intersections off the line of travel while still keeping the system 100 relatively insensitive to tree and vehicular obstacles as well as to fog, snow, and other adverse weather conditions. The UHF transmitter 160 can be turned off and on by the vehicle information transmission system 300 through actuation of a signal line 166.

Figure 6:
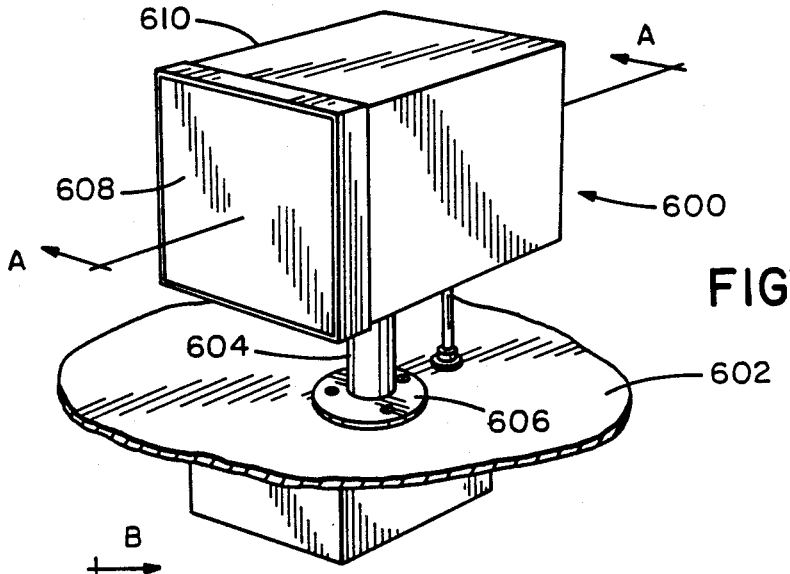
FIG. 6 is a perspective view of the directional antenna 600 shown as a block element in FIG. 1.
Figure 7:
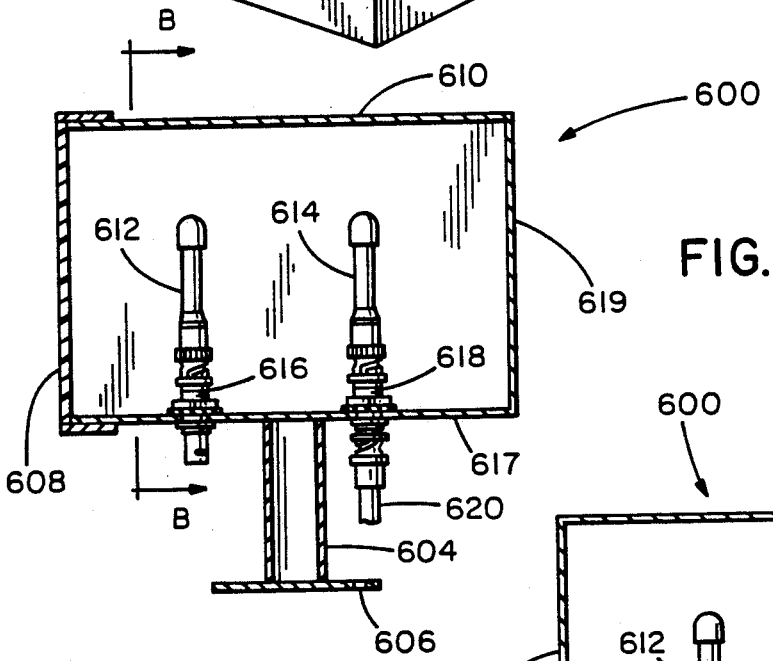
FIG. 7 is an elevational, sectional view of the antenna 600 with the section taken along the line A—A in FIG. 6.
Figure 8:
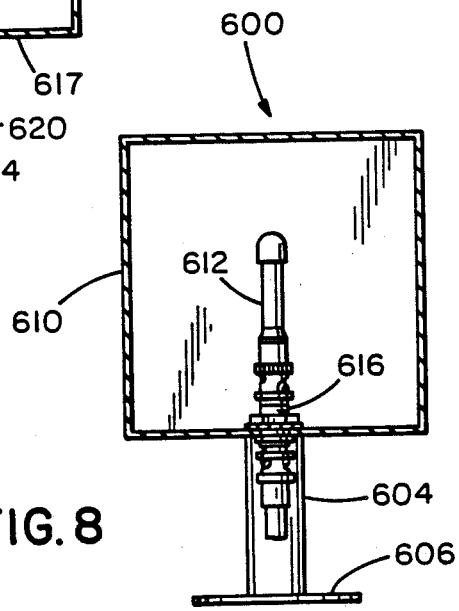
FIG. 8 is a side, sectional view of the antenna 600 with the section taken along the line B—B in FIG. 7.

A radio signal output from the UHF transmitter is applied by means of a radio frequency line 168 to a directional antenna 600 the details of which are shown in FIGS. 6 to 8. The antenna 600 generates directional radio signals 170 which are beamed toward intersections ahead of the vehicle upon which the vehicular unit 102 is mounted.

Figure 4:
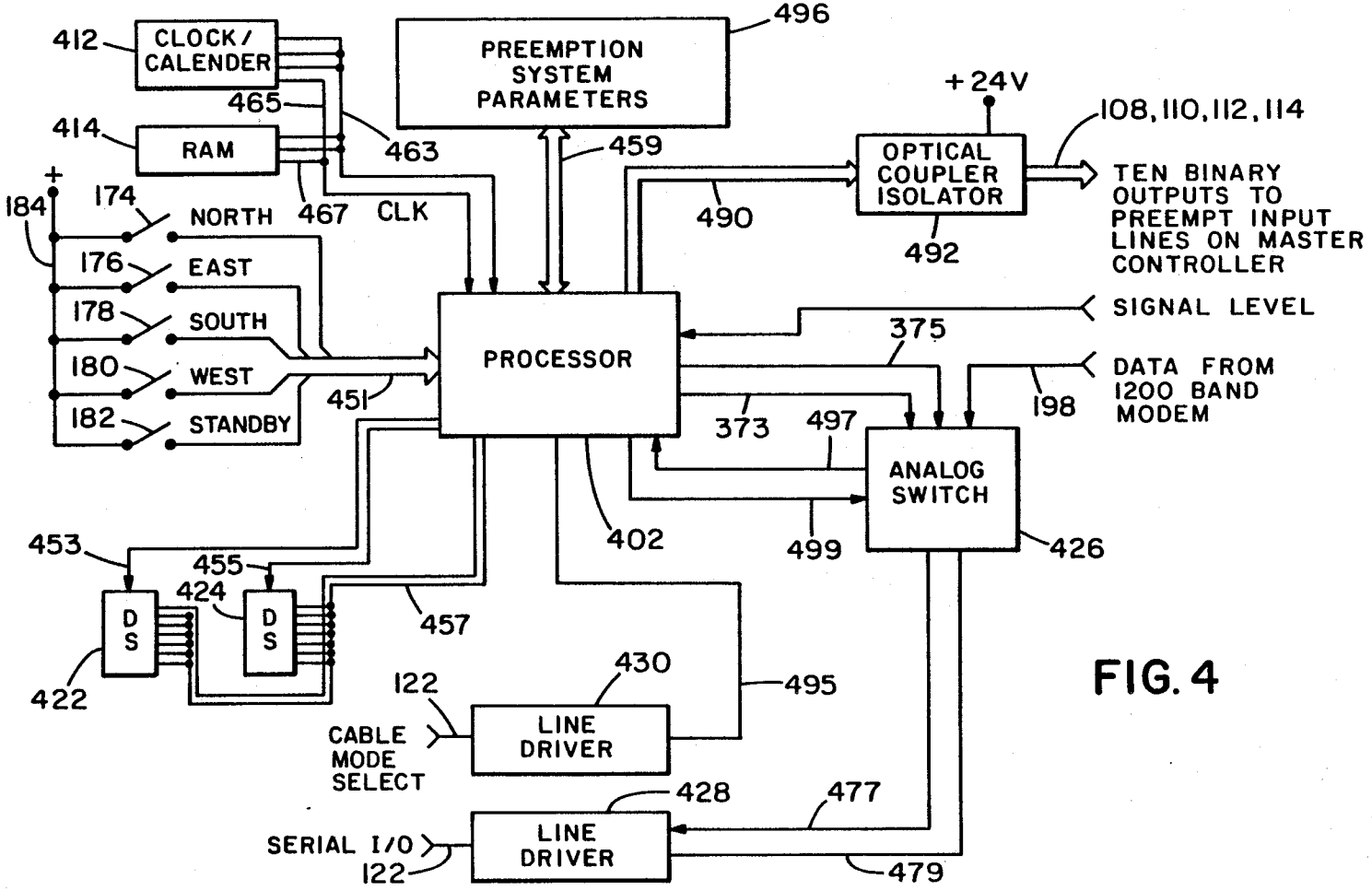
FIG. 4 is a partly block, partly schematic diagram of the vehicle detection, identification, and preemption system 400.

The traffic controller unit 104 includes a vehicle detection, identification, and preemption system 400 the details of which are shown in FIG. 4. Included within the system 40 are tables 501 listing vehicle identification and priority values. Associated with each such value is a preset direction from which that particular vehicle is typically expected to approach the intersection. The values in the table 501 may be altered by means of the control panel and central database 116 whenever desired or when new vehicles are added to the fleet of emergency vehicles. If the present push button 134 is actuated in a vehicle unit 102, the directional radio signals 170 cause receiving traffic controller units 104 to select from the tables 172 the preset direction for that particular vehicle, as identified in the signals 170 which convey the vehicle I.D. and priority number 206 to the traffic controller units 104. If one of the push buttons 126 to 132 which designates a specific direction is actuated, then the traffic controller unit 104 selects the direction specified. The unit 104 then actuates the appropriate signal 108 to 114 to initiate preemption of the intersection n favor of the approaching vehicle.

Incoming radio signals 170 are captured by an omnidirectional antenna 186 and are fed over a signal line 192 to a UHF receiver 188. The modulation tones recovered from incoming signals are fed over a signal line 194 to a 1200 Baud modem 190 where the signals are transformed into a data stream that is fed serially to the system 400 over a signal line 198. A "signal level" signal 195 is extracted from the gain control circuitry of the receiver 188 and is fed to the system 400 so that the system 400 can estimate, by means of the signal strength, how far from the intersection of the vehicular unit 102 is located. The system 400 also counts the number of transmissions received and does not initiate a preemption until the proper number of transmission so the proper strength containing valid vehicle I.D. and priority codes are received within a specified maximum time interval.

The switches 174 through 180 are used for testing the vehicle detection, identification, and preemption system 400 to ensure that it is working properly and that the connections between it and the main traffic light controller 106 are properly arranged. For example, depressing the north push button 174 simulates the receipt of a signal from a vehicle entering the intersection in a northerly direction. In response, the unit 400 will normally actuate the north signal line 108 which causes the traffic light controller 106 to halt all vehicles entering the intersection traveling east, south, or west and to present a green light only to vehicles traveling north. The switches 176 to 180 perform similar testing functions for east, south, and west, and a standby switch 182 disables the system 400 so that it does not actuate the controller 106 but only lamps (not shown) for each direction.

The traffic signal preemption system 100 works in the following manner: When the occupants of an emergency vehicle determine that they must proceed at emergency speeds and preempt intersections as they travel, they begin by typing in the proper security code sequence on the push buttons 126 through 132. Only those who enter the proper security code that matches the code 302 stored within the system 300 can place the system into preemption operation. The valid signal light 150 then flashes to indicate that at the proper code has been entered. The vehicle occupants then depress one of the push buttons 126 through 134. If they are traveling in a northerly direction, they press the north push button 126; if they are traveling east, they depress the east push button 128; and so on. Many vehicles, such as fire engines, travel to the site of an emergency over predetermined paths. In this case, the vehicle occupants may depress the preset push button 134 to signal that the vehicle is approaching all intersections along its normal. preassigned route which is known to the traffic controller units 104 through preprogramming with the control panel and central database 116.

Assuming that the vehicle occupants depress the north push button 126, the N preemption light 140 becomes illuminated to signal that the traffic signal preemption system is now in operation. The vehicle information transmission system 300 generates brief transmissions encoded as is shown in FIG. 2. These transmissions are sent out by the directional antenna 600 along the path of the vehicle so that they reach intersections in front of the vehicle but do not reach intersections off to the side or behind the vehicle. Included within the information transmitted is the vehicle I.D. and priority 306 and an indication of which of the push buttons 126 through 134 was actuated by the vehicle occupants. By keeping these transmissions short and spaced apart, it is possible that several emergency vehicles can approach the same intersection from different directions; and the traffic controller unit 104 at that intersection can receive messages from all of them, determine which vehicles are approaching the intersection from which direction, determine their priority, and decide upon an order in which to initiate preemption in favor of the vehicles. Transmission of the vehicle identification signal continues until a time interval defined by the transmit timeout 304 has expired or until the vehicle occupants actuate the push button 136 which turns the transmitter off or actuate another directional push button 126 to 134. When timeout occurs, the timeout lamp 152 is illuminated.

The vehicle detection, identification, and preemption system 400 can receive transmissions from multiple emergency vehicles at the same time. When transmission are received at a sufficiently strong signal level, the system 400 enters into a table 554 (FIG. 5B) the fact that an emergency vehicle is approaching the intersection. Several vehicles may be approaching the intersection from different directions, and so a separate recordal is made of the vehicles approaching from each direction. The number of transmission received from each direction is also recorded. The system 400 can then make a priority determination as to which emergency vehicle, if there are more than one, should gain control of the intersection. After a predetermined minimum number of transmissions have been received, the system 400 actuates the appropriate signal line 108, 110, 112, or 114 to take over control of the intersection, presenting a green light to the highest priority approaching emergency vehicle and a red light to all other directions. Any second, lower-priority vehicle is then serviced in turn, and so on.

The push buttons 126 to 132 labeled north, east, south, and west and the lamps 140 to 146 are used in applications where an emergency vehicle is approaching an intersection from any random direction, and the operator is simply informing the vehicular unit 104 of the direction from which the vehicle is approaching a given intersection. However, many emergency vehicles, particularly fire engines, have only pre-planned paths over which they travel repeatedly without deviation in traveling to varied portions of the city. In such a vehicle, it may make more sense to label the push buttons and lamps with labels such a "path one," "path two," and so on that the vehicle occupants can select a path of travel rather than a direction of travel. The traffic controller units 104 can then be programmed to respond to the receipt of a signal which designates a path by looking up in the table 501 (FIG. 5) in which direction that vehicle travels when approaching that intersection while traveling along that particular path, and by then preempting in favor of that direction.

FIG. 2 illustrates the timing and content of the signals 170 that are transmitted by a typical vehicular unit 102 to a typical traffic controller unit 104. Referring first to the top of FIG. 2, there is shown at 202 a waveform which illustrates the times when the UHF transmitter 160 in FIG. 1 is turned off and when it is turned on. In the preferred embodiment of the invention, the transmitter 160 is turned on for periods of approximately 34 milliseconds and is then turned off for roughly ten times that interval—300 milliseconds plus or minus 30 milliseconds. The plus or minus 30 milliseconds is a random amount of time that is used to ensure that two vehicles, through transmitting their identification signals simultaneously in precise synchronism, do not block each other from preempting an intersection. By randomly varying the time between the successive transmissions of identification signals, the two vehicles will quickly reach a state where their transmissions are nonsynchronous and therefore receivable by the traffic control unit 104.

At the center of FIG. 2 there is shown at 203 the same waveform enlarged to reveal the information content of the 34 millisecond interval during which the transmitter is turned on. After a 5 millisecond guard interval during which the transmitter settles down, three bytes of information formatted internally as shown at 204 at the bottom of FIG. 2 are transmitted serially one after the other. These three bytes are then followed by a 5 millisecond period before the transmitter is again turned off. Each byte of information is transmitted for roughly 8 milliseconds, so the entire transmission period is 3 times 8 milliseconds plus 10 milliseconds, or 34 milliseconds.

The first byte of information always has its seventh bit set to "1" to identify it as the first byte. The remaining bytes zero through six contain the vehicle ID and priority number. This scheme permits up to 127 unique vehicle ID and priority codes. If that is not a sufficient number, then the first four bytes of the final byte or third byte may contain three more bits to represent the vehicle identification and priority number, giving a total of 2,048 unique identification and priority numbers. The seventh bit of the third byte of information is always "0".

The second byte of information transmitted has its seventh bit always set to "0" to distinguish it from the first byte. In this second byte, bits zero and one specify the direction in which the vehicle is traveling and permit the specification of up to four directions. Bit two is a preemption bit which is set if the preset direction is selected by depressing the push button 134. Bit 6 is set to "0" if there is no third byte and to "1" if a third byte follows containing an additional portion of the vehicle ID and priority number.

Referring to the bottom of FIG. 2, at 204, the arrangement of a single transmitted byte is shown. The formatting within each data byte is shown to be the standard form used for asynchronous serial communication at 1200 Baud. A start bit 212 is followed by eight data bits 214 followed by a stop bit 216, so ten bit timing intervals define each asynchronous character transmitted.

FIG. 3 presents the details of the vehicle information transmission system 300 in FIG. 1. With reference to FIG. 3, the system 300 is constructed around a programmed processor 308 taken from the Motorola M6801 family. The particular processor used in the preferred embodiment of the invention is the XC68HC811A2FN microprocessor. The push button switches 126 through 136 connect to the processor 308 over the bus 351 that connects the switches 126 through 132 to the port A bus input bit lines zero through two and seven and connects the present and off switches 134 and 136 to the port C bus bits four and five. A pair of DIP switches 322 and 324 are selected by microprocessor port C output bit zero 353 and one 355 respectively and present their return data to port E bits zero through seven over a bus 357.

The values 304, 306, and 302 (also shown in FIG. 1) and the transaction log 310 (FIG. 3) are connected to the processor 308 by busses 359 and 361 which indicates these values are stored within the random access memory or EEPROM memory of the processor 308. Additional random access or EEPROM memory 314 and a clock/calendar circuit 312 connect to lines 363 and 365 which connect to the port D serial communications interface of the processor 308, bits three and four, and are provided with processor clock or timing pulses over a line 367. In this manner, the processor 308 may access information in the random access or EEPROM memory 314 and may also obtain the time of day and date for inclusion in the log 310.

The light emitting diodes which constitute the lamps 140 through 148 (shown in FIG. 1) are connected to the processor 308 port A bits three through six and also port C bits two and three. A beeper 318 within the vehicular unit 102 is connected by means of an optical coupler 316 to bit zero of port B by a signal line 369, with the optical coupler 316 providing electrical isolation. The third bit of port B is extended over signal line 317 to a switch which can open or close the connection between the line 166, which powers the UHF transmitter 160, and a positive potential reference 372 thereby turning the UHF transmitter 160 on and off. Bits one and two from the B bus flow over signal lines 373 and 375 to an analog switch 326 which determines whether the serial input and output lines extending from port D bits zero and one are connected to a line driver 328 which leads to the serial input/output lines 120 that connect to the control panel and central database 116 or to the 1200 Baud modem 158 over the signal path 162. The analog switch 326 is connected to the line driver 328 by signal lines 377 and 379. To facilitate the identification of the control panel and central database 116 (FIG. 1), one line 329 from the serial input/output 120 connects to a line driver 330 which is fed into the fourth bit of port C so that the processor 308 can test to determine when the control panel and data base 116 is connected to the vehicular unit 102.

FIG. 4 illustrate the details of the vehicle detector, identification, and preemption system 400. This system 400 is also centered around a processor 402 which, in the preferred embodiment of the invention, is identical to the processor 308 used in the vehicle information transmission system 300 shown in FIG. 3, differing only in how it is programmed The test switches 174 through 182 are connected by a bus 451 to port A of the processor bit positions 3 through 6 and port C bit position 4. A pair of dip switches 422 and 424 are selected respectively by the port C bit zero signal 453 and the port C bit one signal 455, and the switches 422 and 424 present their settings to bits one through seven of the port E input bus 457. A random access memory or read only memory 414 and a clock/calendar 412 are connected to bits two and four of port D by lines 463 and 465 and to a source of clock timing pulses by a line 467.

Output information from the processor 402 destined for delivery to the main traffic light controller 106 (FIG. 1) is presented by a bus 490 which extends from bit positions zero to seven of port B and bit positions six and seven of port C through an optical coupler and isolator 492. Preemption signals 108, 110, 112, and 114 shown extending to the main traffic light controller 106 in FIG. 1 are included in this ten-signal bus, and the additional signals are provided for use in cases where the controller 106 may need to be programmed in a more sophisticated manner.

Serial input to and output from the processor 402 is provided respectively over bit lines zero 497 and one 499 of port D which connects to an analog switch 426. The analog switch 426 is controlled by bit signals one 373 and two 375 from port D. The analog switch 426 can route signals from the 1200 Baud modem 190 (FIG. 1) input data line 198 to bit position zero of port D, or it may connect the processor 402 directly over lines 477 and 479 to a line driver 428 that connects to the serial input/output 122. And as in the system 300, the system 400 includes a line driver 430 which can connect a signal 122 from the serial I/O that identifies the presence of the control panel and central database 116 by feeding another signal 495 into bit position five or port C.

The preemption system's parameters 496 that control its operation are stored in a memory which connects to the processor 402 by a bus 459. The memory which contains the preemption system's parameters 496 in the preferred embodiment of the invention includes random access memory and also an EEPROM, or electronically erasable programmable read only memory.

FIG. 5 presents the preemption system's parameters 496 which are shown as a single block element in FIG. 4.

A first table 501 relates vehicle identification and priority numbers 502 to the present direction 504 assigned to each vehicle at each intersection. This preset direction 504 is the direction in which the system 400 presumes a vehicle is traveling unless the vehicle signals some other specific direction. With reference to FIG. 1, if an occupant of a vehicle depresses the preset push button 134, then the system 400 looks to the table 501, finds the match 502 for the vehicle ID and priority, and extracts from the table 501 the present direction 504 in which the emergency vehicle is presumably moving.

The log 310 (FIG. 4) is set forth in a table 506 each entry of which contains a date 508 and time 510, the vehicle identification and priority 512, the duration of the preemption 514, and the direction in which the vehicle is moving 516. A log entry is made following the termination of each preemption event. These logs, as well as any log maintained in vehicular units 102, are downloaded into the control panel and central database 116 from which they may then be printed out as reports which give a complete record of all preemptions.

A table of 518 contains the valid signal interval data. At 520, this table contains the minimum number of transmissions which must be received by the traffic controller unit 104 before a transmission series is presumed to be valid. This number of transmissions must be received within the maximum time for counting transmission 522 and must be presented by a signal having the specified minimum signal strength 524. The contents of the table 518 thus determine the minimum standards for a preemption signal to be considered valid.

A table 526 assigns directional priorities in cases where emergency vehicles having the same base priority enter the intersection from several different directions simultaneously. In FIG. 5, the south table entry 530 is assigned the highest priority 4, the west entry 534 is assigned 3, the east entry 532 is assigned 2, and the north entry 528 is assigned 1. A recall priority table 536 contains recall priority values indicating, for each possible direction of an approaching emergency vehicle requesting preemption, to which direction priority for normal traffic is to be given following the preemption. In the example shown, the north, south, and west table entries 538, 540, and 544 are each assigned the recall priority of east, while the east table entry 542 is assigned the recall priority south. In the preferred embodiment of the invention, north is indicated by 0, east by 1, south by 2, west by 3, and no recall priority is indicated by 15, or F hexadecimal.

Table entry 546 contains the maximum permissible duration for a preemption. Table entry 548 contains the minimum preemption duration. Table entry 530 specifies the minimum time a preemption will continue after the preemption signal has been lost. Table entry 552 specifies the minimum time following a preemption that the system locks out any attempt by that same vehicle to preempt the same intersection again.

Taken together, the parameters 496 in FIG. 5 specify precisely how preemption is to take place at a given intersection with respect to each vehicle approaching from the various possible directions. Since intersections will differ widely in their traffic patterns and in the speed with which vehicles approach and therefore the nature of the preemption signals and the duration, these parameters may differ significantly from one intersection to another within the same city. Additionally, as emergency vehicles are added or deleted and as the routing of those vehicles is altered, the information contained in FIG. 5 is altered to reflect the changes.

All the tables 501, 518, 526, 536, 546, 548, 550, and 552 are maintained in EEPROM memory. The log table 506 and the table 554 (FIG. 5B) are stored in RAM memory.

Figure 5A:
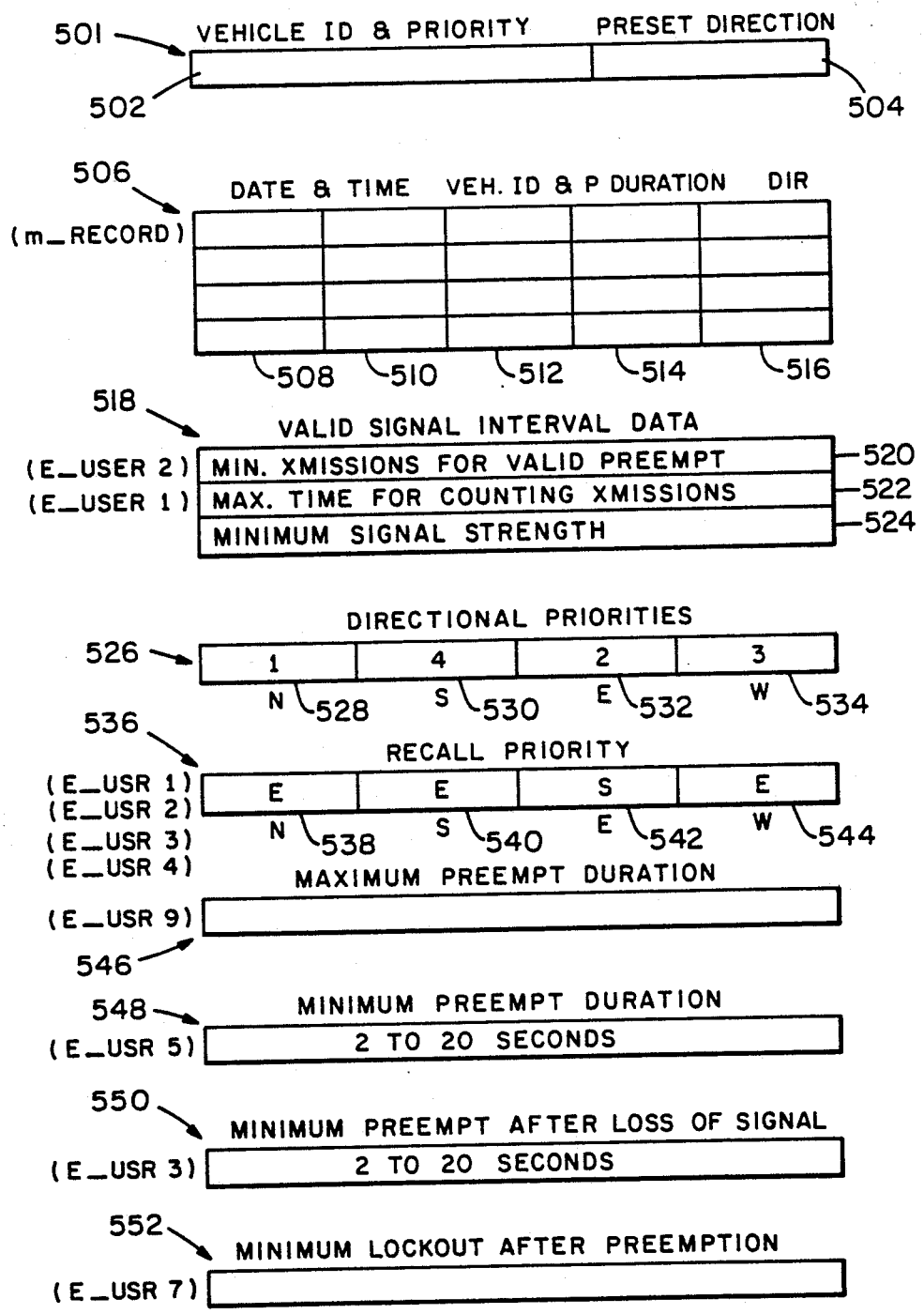
FIG. 5A and 5B are block memory layout diagram illustrating the nature of the preemption system parameters 496 within the system 400 shown in FIG. 4.
Figure 5B:
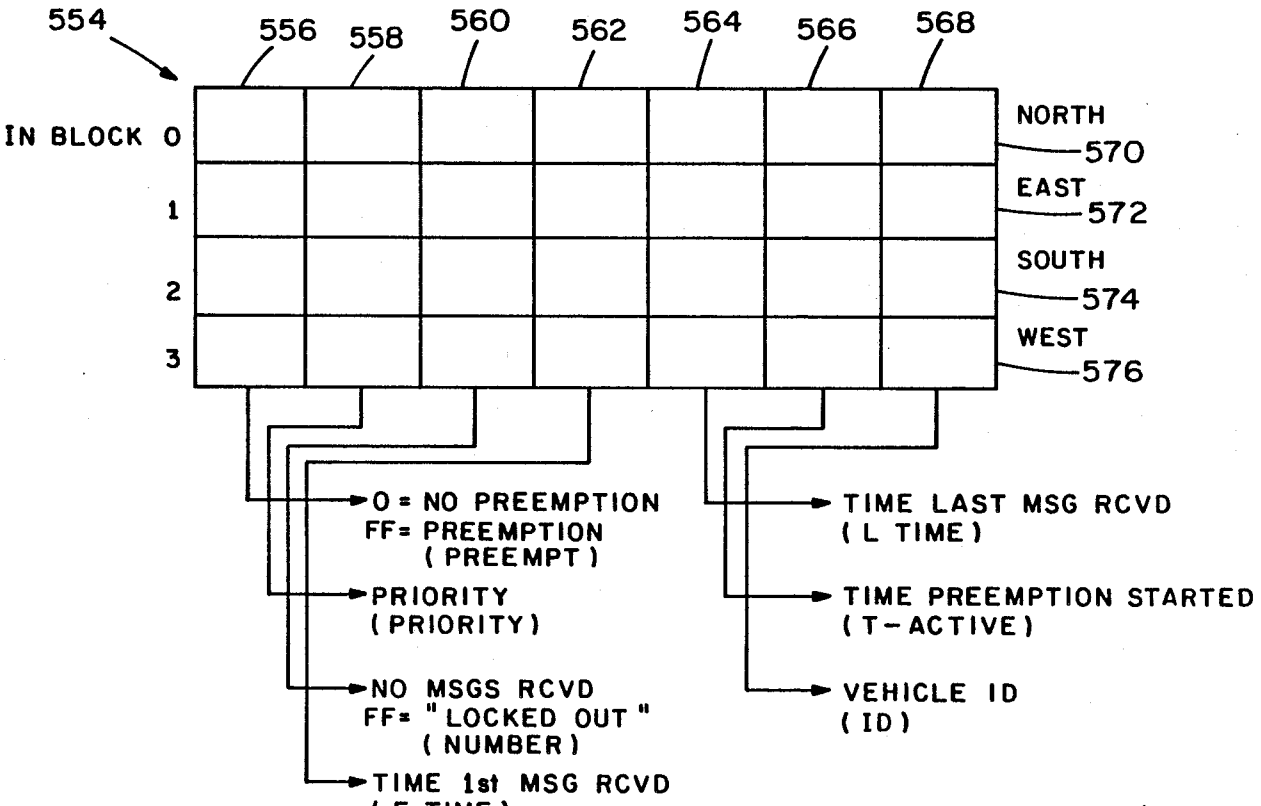

FIG. 5B, which is a continuation of the preemption system parameters 496, presents a table 554 which is continuously altered by the traffic controller unit 104 to reflect the current preemption status of the intersection. The table 554 contains north 570, east 572, south 574, and west 576 rows each of which reflects the status of the intersection for emergency vehicles approaching the intersection in the direction specified. In the preferred embodiment of the invention, the traffic controller unit 104 does not maintain information pertaining to all emergency vehicles that may be approaching the intersection at any given moment in time but only with respect to the highest priority vehicles approaching from each of the four possible directions. If two emergency vehicles having the same priority are approaching from the same direction, then the table 554 will alternately identifies one or the other of the two vehicles depending upon which was the last from which a message has been received. It is contemplated that a larger table could maintain information on all approaching vehicles.

Column 556 of the table 554 contains "0" if there is no preemption in favor of a particular direction, and it contains hexadecimal "FF" to signal an active preemption in favor of that particular direction. Column 558 contains the priority and column 568 contains the vehicle I.D. for the highest priority vehicle that is approaching the intersection from a given direction. Column 560 records how many messages of the proper strength have been received from the highest priority vehicle approaching from each direction. As each new message is received, the number in column 560 for that direction is incremented except at times when a given direction or vehicle is locked out by the system. Lockout of a particular vehicle is initiated immediately following termination of preemption in favor of that vehicle to prevent an accidental second preemption ion favor of the same vehicle. To signal that a given direction is locked out, the hexadecimal number "FF" is placed in the appropriate position in column 560, and the vehicle I.D. is retained.

The columns 562, 564, and 566 keep track of the times when critical preemption events have occurred for each direction. Column 562 remembers the time when the first message of sufficient strength was received from a vehicle approaching from a given direction. Column 564 indicates when the last message was received from that vehicle, and column 566 indicates when preemption was started. These values, taken together with those shown in FIG. 5A, provide all the necessary information whereby the traffic controller unit 104 in the preferred embodiment of the invention can determine whether and when to initiate a preemption and when to terminate a preemption.

FIGS. 6, 7, and 8 present the mechanical details of the direction antenna 600. The antenna 600 is designed to be mounted on an external surface of an emergency vehicle 602. It includes a mounting standoff or pipe 504 attached to a mounting flange 606 which flange 606 may be bolted or otherwise attached to the surface 602 of the emergency vehicle. The antenna 600 is mounted in such manner that its front surface 608 faces in the forward direction towards intersections which the emergency vehicle is approaching.

The directional antenna 600 is constructed as a rectangular metal housing 610 supportatively mounted on the standoff or pipe 604 and having a front surface 608 that is nonmetallic and transparent to electromagnetic radiation. The front surface 608 is constructed from Lexan, a high temperature plastic. The housing 610 is roughly one-quarter wavelength tall by one-quarter wavelength wide and has a square cross section, as is shown in FIG. 8.

A pair of antenna stubs 612 and 614 are mounted on the lower surface 617 of the housing 610 by means of a pair of 50 ohm, male-male BNC connectors 616 and 618 which are bolted to the surface 617. As is apparent in FIG. 7, the stubs 612 and 614 are mounted one behind the other one-eighth wavelength apart. The hindmost antenna stub 614 is the driven element, since the BNC connector 618 is connected to the 50-ohm coaxial cable 620 which corresponds to the signal line 168 in FIG. 1. The stubs 612 and 614 are helically wound antennas tuned to the frequency of the transmitter (Larson part number KDL450). The stubs 612 and 614 as purchased as tuned to 450 megacycles. The front or direction stub 612 is modified by the removal of about 5% of its winding, or roughly one-half turn.

The driven antenna stub 614 can be moved closer to the front surface 608 to increase antenna efficiency or further back to increase the directionality of the antenna. But without the director stub 612, there is too much radiation at 45 degrees to the left or right of straight ahead. The director stub 612, when detuned and positioned as explained above, gives a more acceptable, forward-directed radiation pattern with less radiation at 45 degrees, thereby minimizing the likelihood of sending strong signals to traffic signal controllers on cross streets.

In the preferred embodiment, the housing 610's internal dimensions are approximately 8 inches deep (front to back) by 5 3/16 inches high and wide. The driven element is approximately 2 5/8 inches forward from the rear wall 618 of the housing 610, and the two antenna stubs are approximately 3 1/16 inches apart, measured between their central vertical axes.

The omni-directional antenna 186 (FIG. 1) is constructed from one driven antenna stub (not shown) identical to the stub 614 (FIG. 6) but mounted on a suitable ground plane and not enclosed in a metallic housing 610. In the preferred embodiment, the antenna stub for the antenna 186 is enclosed from above and from the sides by a jar-like glass housing painted black which protects it from the weather.

DETAILED DESCRIPTION OF THE PROGRAMMING

The vehicle information transmission system 300 and the vehicle detection, identification, and preemption system 400 both include programming that directs the operations of the processors 308 and 402 within the respective systems. That programming is described below.

Figure 9:
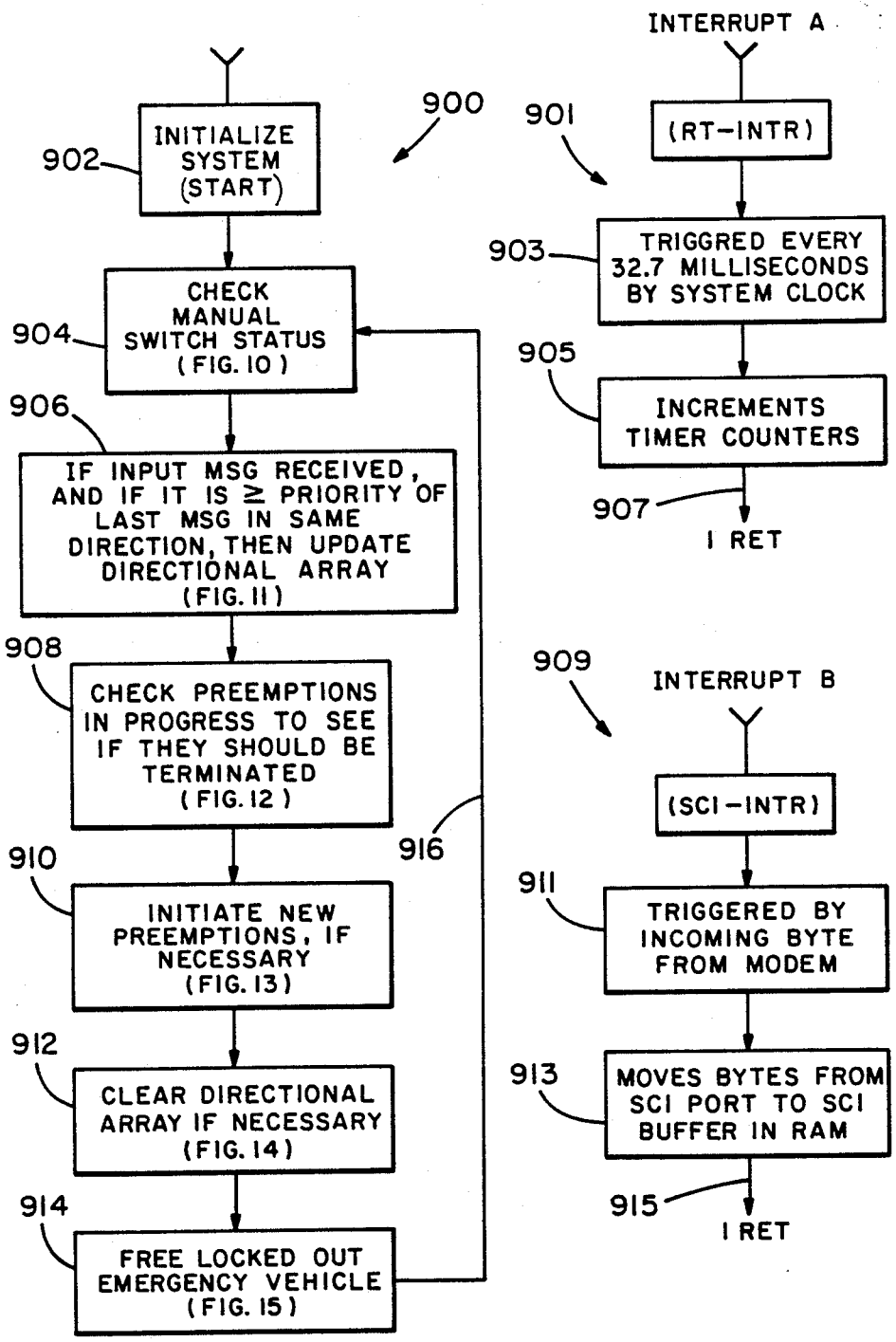
FIGS. 9 through 18 are flow diagrams of the programs 900 for the processor 402 (FIG. 4) within the vehicle detection, identification, and preemption system 400 (FIGS. 1 and 4)

Referring now to FIG. 9, three programs are shown which constitute the programming for the processor 402 within the vehicle detection, identification, and preemption system 400. A main program 900 is represented by an overview block diagram in the left half of FIG. 9. Two interrupt programs, interrupt A 901 and interrupt B 909, are shown to the right in FIG. 9. The main program 900 does not have a name. The interrupt programs A 901 and B 909 and the many subroutines illustrated in the figures that follow do have names which are indicated in first block of each set of block diagrams enclosed in parentheses. The name of the interrupt program A 901 is RT-INTR, while the name of interrupt program B 909 SC-INTR. These names enable the block diagrams in the figures to be related easily to the corresponding program code in the listings set forth towards the end of this detailed description. (Similar parenthesized program names appear in later figures and also in FIG. 5.)

The interrupt A program 901 is triggered into operation once every 32.7 milliseconds by the system clock, as is indicated at 903. This program increments various system counters (at 905) which are used for timing real-time events. Then it terminates at 907 and returns program control to the interrupted program.

The interrupt B program 909 is triggered into operation at step 911 by the receipt of a data byte from the 1200 Baud modem 190 (FIG. 1). When the interrupt B 909 is triggered into operation at step 911, it simply moves the byte received from the serial communications interface port within the microprocessor 402 into the serial communications interface buffer within random access memory (step 913). Then it returns program control to the interrupted program at 915.

The main program 900 begins at 902 by initializing all the various system constants and variables and by setting up interrupt vectors pointing to the interrupt routines 901 and 909 and initiating their operation. At 904 the program 900 checks the status of the manual switches 174 through 182 and services them if necessary. At 906, and with reference to the preemption table 554 shown in FIG. 5B, the system 400 checks to see if an input message has been received, and if so whether it is greater than or equal to the priority of the last message received specifying the same direction. If so, then the directional array 554 shown in FIG. 5B is updated.

Next, at 908, the program 900 checks the preemptions in progress, again by reference to the table 554 shown in FIG. 5B, to see if any should be terminated. Additionally, at 910 the program 900 checks the preemption table 554 to see if any new preemptions should be initiated. At 912, the program 900 checks to see if any table entries should be cleared. Finally, at 914, the program 900 checks up on any vehicle that has been locked out from further preemption, so that they do not re-preempt an intersection while they are travelling away from it, to see if such a lockout should be terminated. Then program control returns back to 904 along the path indicated by the line 916 and recommences in an endless loop that continues indefinitely.

Figure 10:
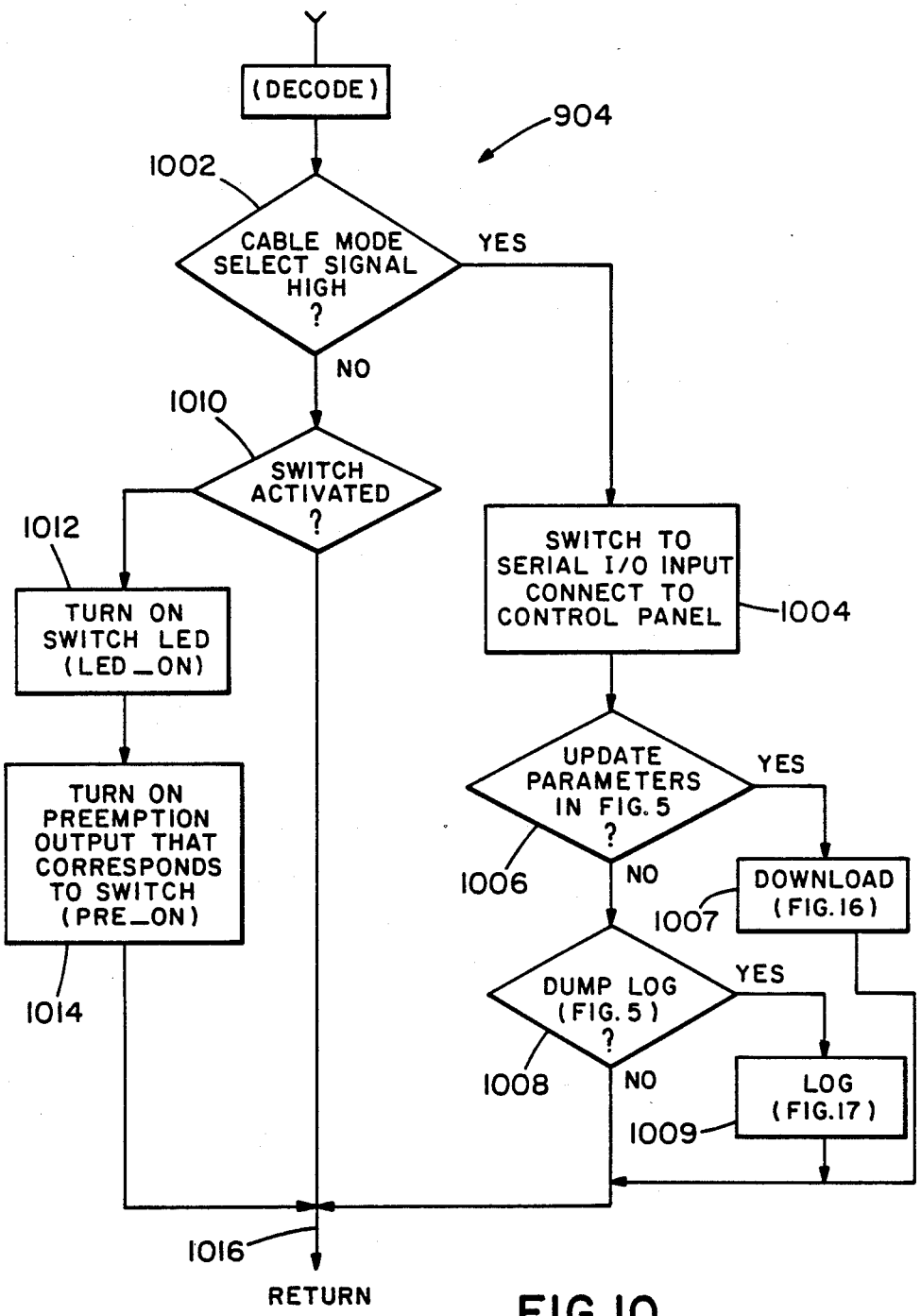
Figures 16, 17:
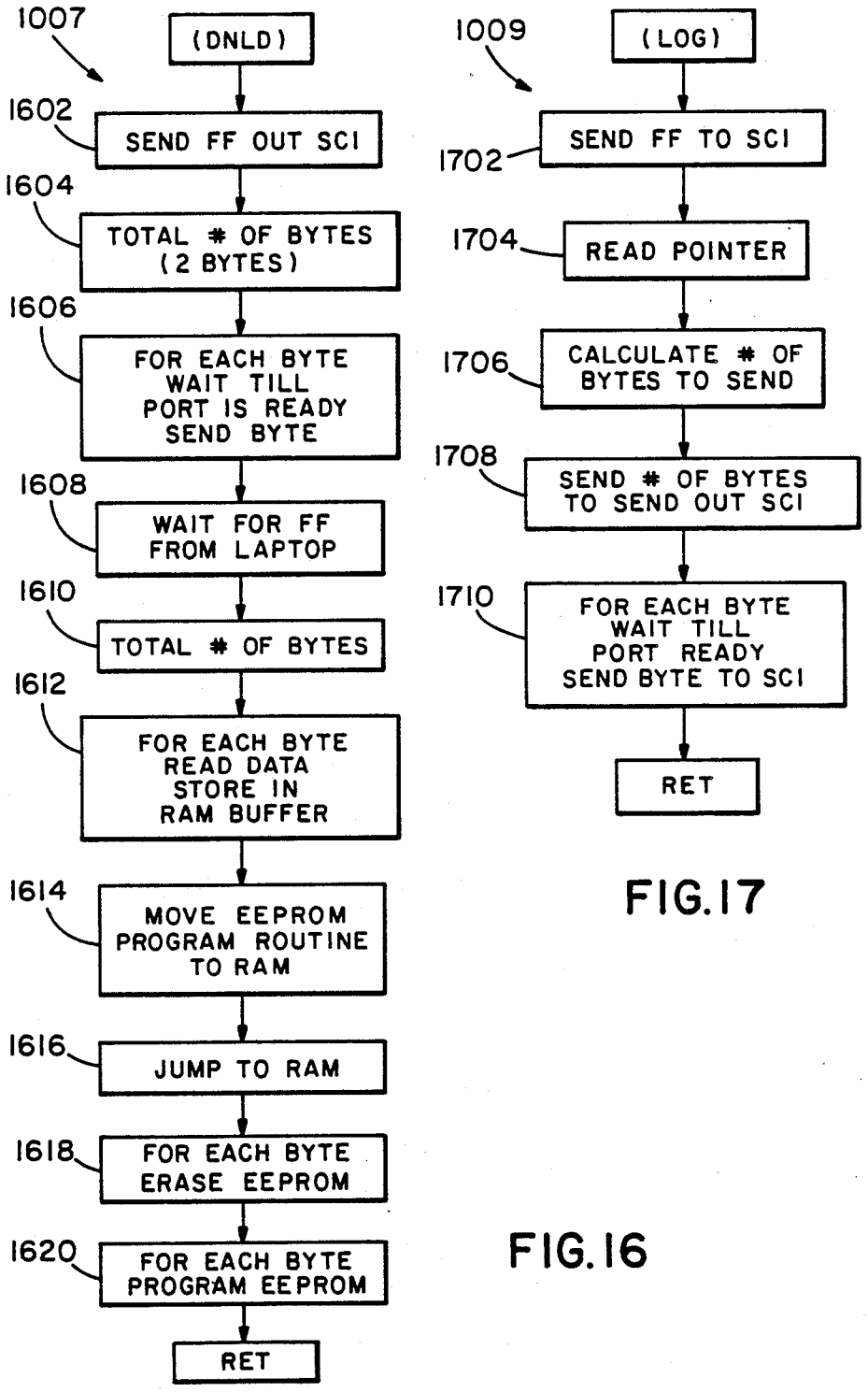

FIG. 10 presents a detailed block diagram of the Subroutine 904 which checks the status of the manual switches. Before doing so, at 1002 the Subroutine 904 checks to see if the cable mode select signal 495 is high. With reference to FIG. 4, this is the signal 495 which indicates when a cable connecting to the control panel and central database 116 (FIG. 1) is hooked up to the unit. If so, then the step at 1004 actuates the analog switch 426 (FIG. 4) and connects the processor 402 to the line driver 428 which leads to the control panel and central database 116 (FIG. 1). Next, at steps 1006 and 1008, the subroutine 904 checks to see if the parameters in FIG. 5 are to be updated or if the log maintained at 506 in FIG. 5 is to be dumped. If the parameters are to be updated, the subroutine 1007 shown in FIG. 16 is run to download the parameters from the control panel and central database 116 into the table shown in FIG. 5. If a log 506 is to be dumped, then the subroutine 1009 shown in FIG. 17 is placed into operation.

If the cable mode select signal 495 is not high, then at 1010 the computer tests to see if any of the switches 174 to 182 are actuated. If so, then a corresponding switch lamp (not shown) is turned on at 1012, and the preemption associated with the direction of the actuated switch is placed into operation at 1014. Then program control returns to the calling program at 1016.

Figure 11:
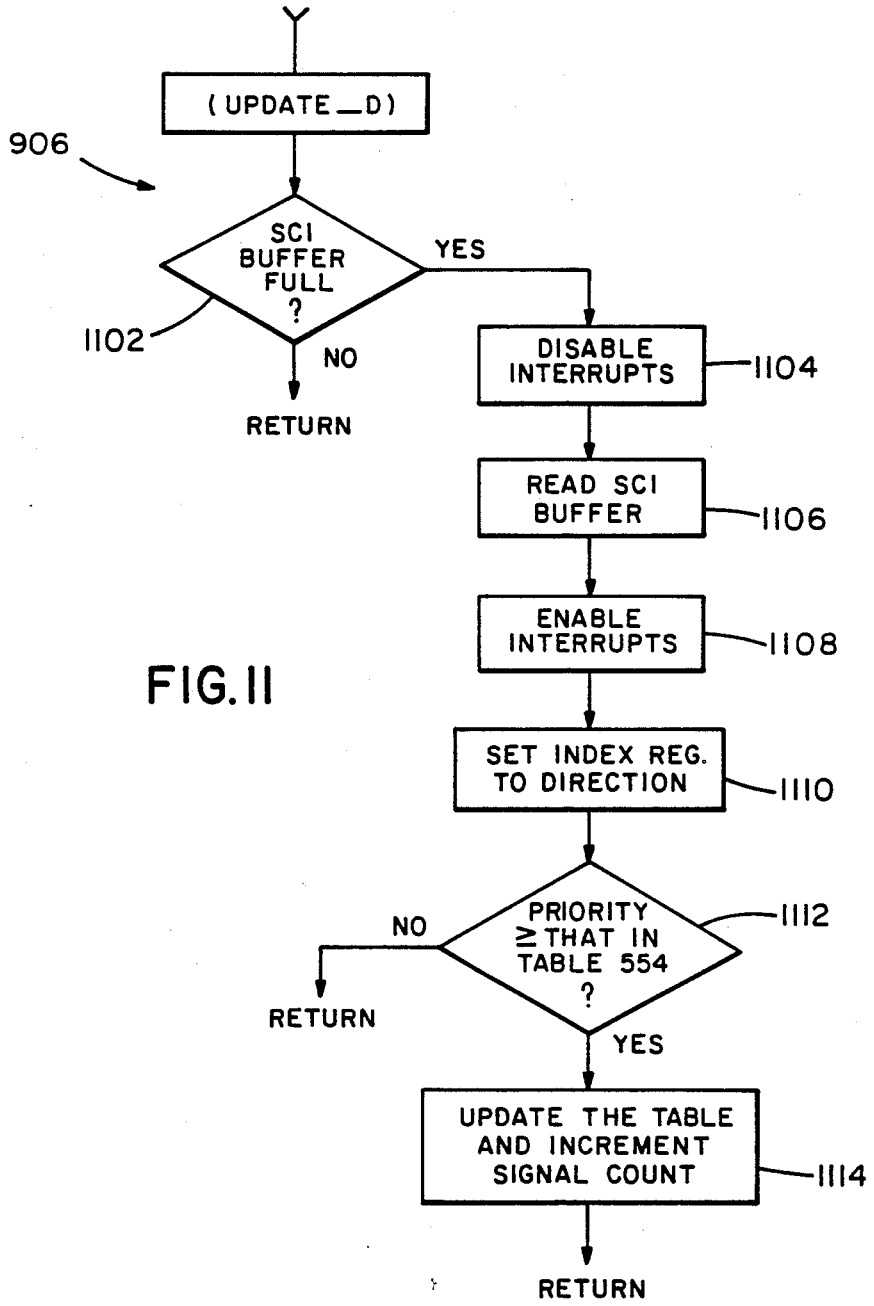

FIG. 11 illustrates the details of the subroutine 906 which checks to see if a complete message has been received from the transmitter, and if so, updates the information in a table 554 (FIG. 5). The individual incoming characters are processed one by one by the interrupt B program 909 shown in FIG. 9. The individual characters are stored in a serial communications interface (SCI) buffer in random access memory. Referring back to the subroutine 906 in FIG. 11, when the SCI buffer is full and a complete message has been received, as determined by step 1102, all interrupts are disabled temporarily at 1104 while the serial communications interface buffer is read (at 1106), and then interrupts are enabled again (at 1108). The disabling of interrupts prevents new characters from being written into the buffer while an earlier message is being transferred out. At 1110, an index register is set to a number (0 to 3) that corresponds to the direction from the which the message came to facilitate accessing the table 554 in FIG. 5B. Next, the priority entry 558 in the table 554 for the direction from which the message came is tested. If the new message is equal to or higher in priority than any message already in the table, as determined at step 1112, then table entry 560 for that direction is incremented, and other entries in the table 554 are updated with information about the vehicle from which the most recent message has come.

Figure 12:
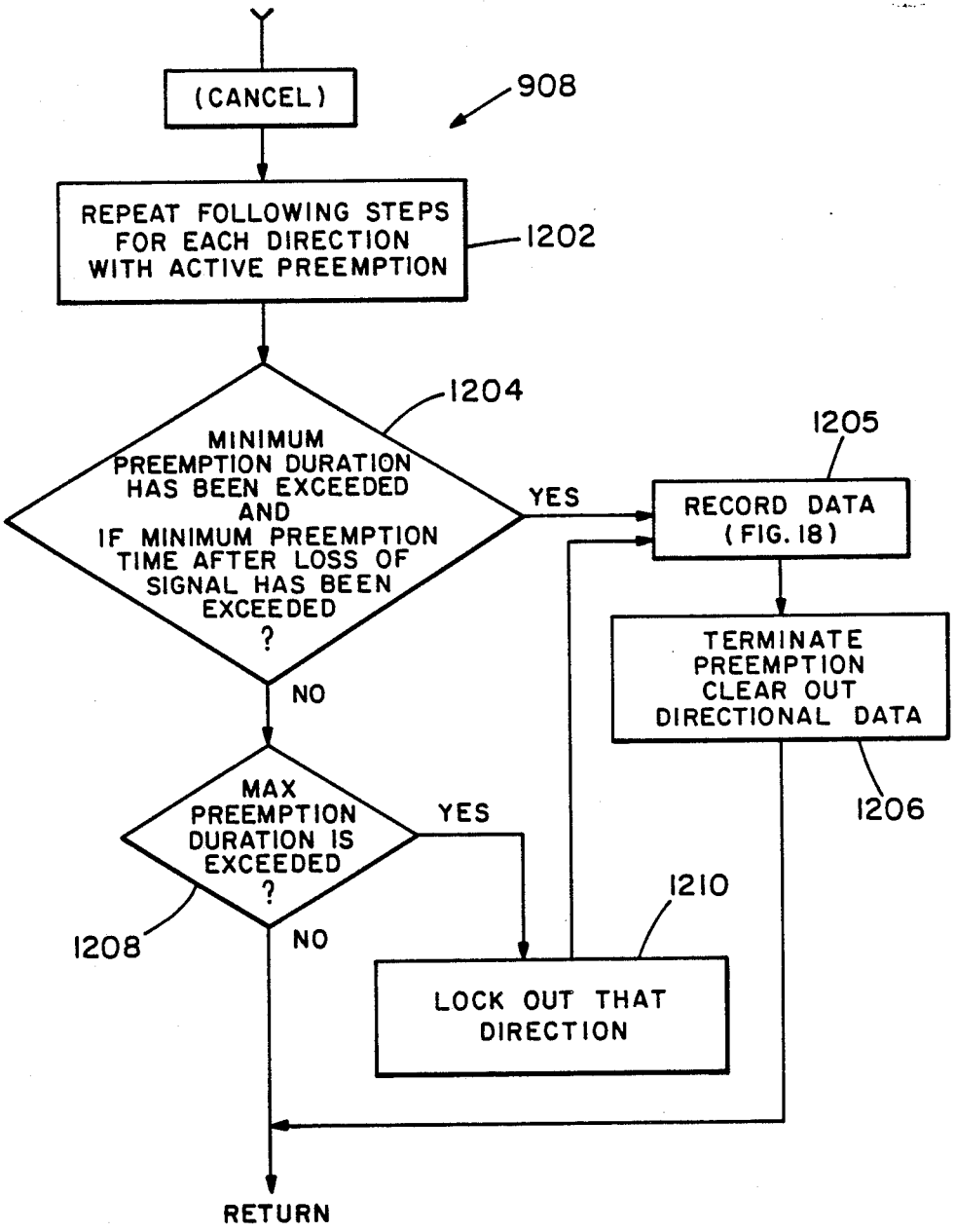

The subroutine 908, which checks preemptions in progress to see if they should be terminated, is set forth in FIG. 12. Step 1202 indicates that the following steps are to be repeated for each of the possible directions that has an active preemption in progress. At 1204, a two-part test is conducted to determine if a minimum preemption duration value 548 (FIG. 5A) has been exceeded, and if the minimum preemption time after loss of signal 550 (FIG. 5A) has been exceeded. If both of these tests are true, then the record data routine 1205 (FIG. 18) is called to log the preemption event. Then at 1206 the preemption in cleared by writing zero into the appropriate entry in column 556 (FIG. 5B), and the corresponding directional data is cleared out.

If both of the above tests are not true, then at 1208 the subroutine determines whether the maximum preemption duration 546 (FIG. 5A) has been exceeded. If so, step 1210 locks out preemptions coming from that direction by entering hexadecimal FFG into the column 560 (FIG. 5B) where the number of messages received is normally recorded. Then program control continues with step 1205 and 1206 which log and terminate the preemption.

Figure 13:
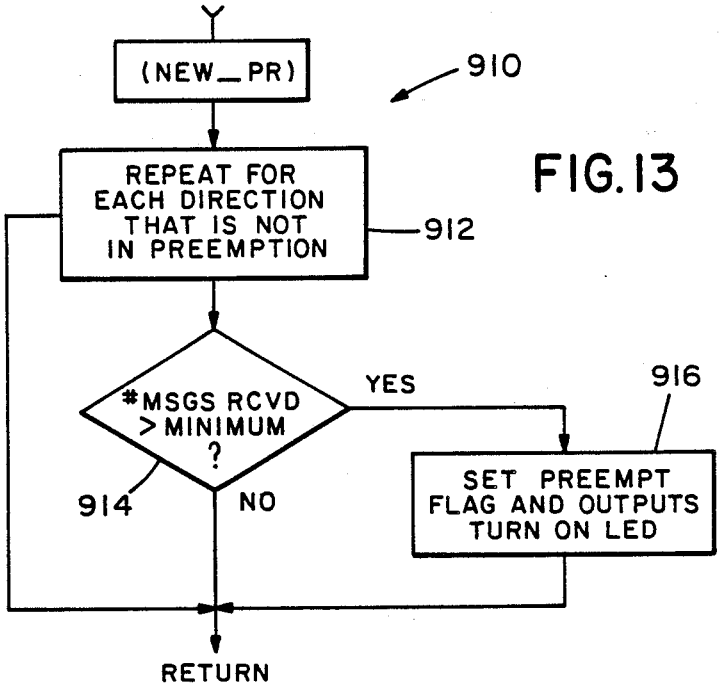

The Subroutine 910 which initiates new preemptions is shown in FIG. 13. Step 912 repeats the following steps for each direction that is not presently in preemption. At step 914, if the number of messages received from a given direction 560 (FIG. 5B) exceeds the minimum value specified in table entry 520 (FIG. 5A), then the preemption flag in column 556 (FIG. 5B) is set, and the appropriate preemption lamp (not shown) is turned on; and if and the standby switch 182 is not set to override preemptions, then the appropriate output signal 490 (FIG. 4) is actuated to initiate a preemption operation at the intersection.

Figure 14:
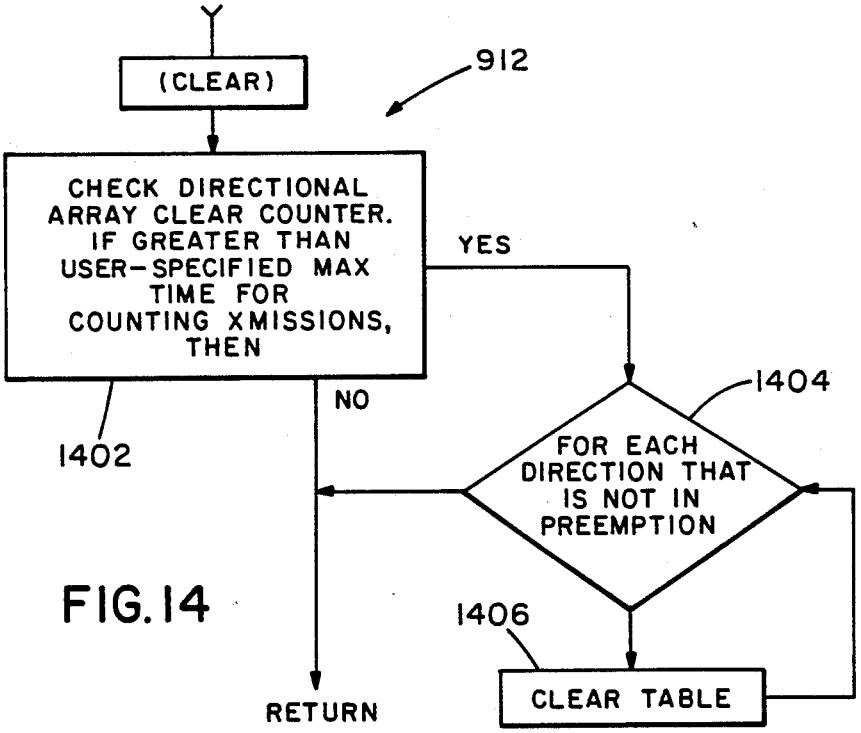

FIG. 14 presents the details of the subroutine 912 which clears the directional table array table 554 entries if necessary. The purpose of the subroutine 912 is to prevent the initiation of a preemption if the proper minimum number of preemption messages are not received within the specified minimum time. At step 1402, the subroutine checks the maximum time for counting transmissions 522 and compares this time to the value in a directional array clear counter which is incremented by the interrupt A program 901 step 905 (FIG. 9). If the count is greater than the maximum time for counting transmissions, then the clear counter is cleared. The remaining steps 1404 and 1406 are thus only executed at points in time separated by the specified maximum time for counting transmissions 522.

Once actuated, the steps 1404 and 1406 simply clear the table 554 entries for any direction that is not in preemption. Accordingly, if a count of incoming messages for a given direction does not grow to the point where a preemption is initiated before the Steps 1404 and 1406 are next carried out, the number of messages received count 560 for that direction is cleared back to zero.

Figure 15:
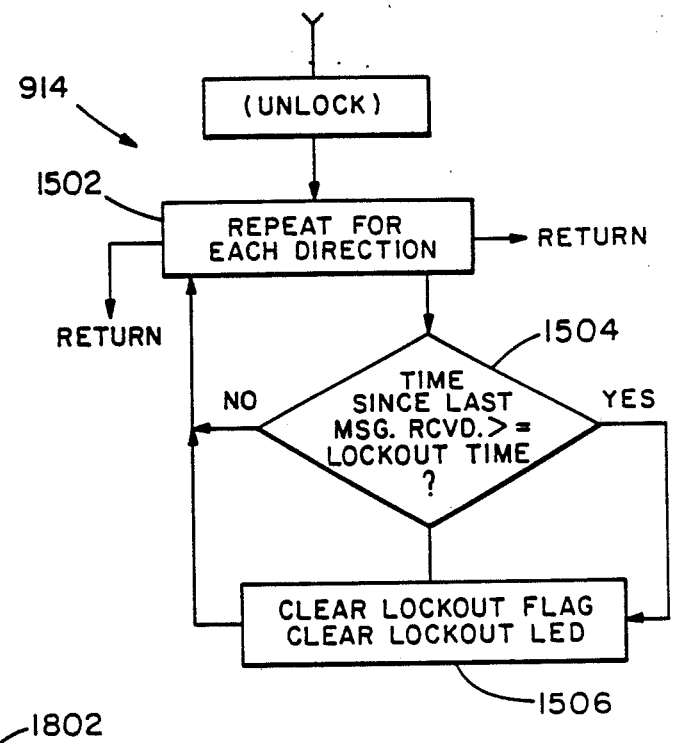

The Subroutine 914 shown in FIG. 15 is the one that freezes up locked-out vehicles which are barred from preemption. preemption. The steps of the subroutine 914 are repeated (Step 1502) for each of the four directions. At step 1504, if the time expired since the last message was received, as recorded in column 564 (FIG. 5B), is greater than or equal to the minimum lockout time specified at 552 (FIG. 5A), then the lockout flag in column 560 (FIG. 5B) is cleared at 1506, so that preemptions from that direction are no longer locked out.

FIG. 16 illustrates details of the Subroutine 1007 which controls the downloading of information from the control panel and central database 116 (FIG. 1) to the vehicle information transmission and preemption system 400. The information downloaded into the system 400 is that shown in FIG. 5A transmitted as a continuous block of information, and the information downloaded into the system 300 is that shown at 302, 304, and 306 in FIG. 1 transmitted as a continuous block of information.

With reference to FIG. 16, the subroutine begins 1602 by sending out the hexadecimal code FF to signal the start of transmission. Next, at 1604, the total number of bytes to be transmitted is sent out as a two byte, or 16-bit number. At 1606, the bytes are transmitted as rapidly as possible, with the subroutine waiting until the serial transmission portions of the processor 308 or 402 are ready before sending out each byte. In this manner, the entire contents of the table shown in FIG. 5A (in the case of the system 400) or the values 302, 304, and 306 shown in FIG. 1 (in the case of the system 300) are transmitted to the control panel and central database 116 where they can be displayed and edited by the system operator. The data is then returned. Beginning at 1608, the subroutine waits for hexadecimal FF from the control panel and central database 116 to signal the beginning of a return transmission. Then at step 1610 the total number of bytes to be transmitted is presented, again as a two byte, or 16 bit number. At 1612, the system 300 waits for each byte, reading it in and transferring it into the random access memory buffer. Next, at step 1614, the subroutine for programming the EEPROM (electronically erasable programmable read only memory) is read into random access memory, and at step 1616 program control begins with that routine. At step 1618, each byte in the EEPROM is erased, and at step 1620 the new bytes are programmed into the EEPROM where they are permanently maintained until the next time information is to be downloaded from the control and central database 116.

FIG. 17 discloses the details of the subroutine 1009 that transmits the log information 310 (FIG. 3) or 506 (FIG. 5A) back to the control panel and central database 116 (FIG. 1) from either the system 300 or the system 400. Program control begins at step 1702 with the sending of a hexadecimal FF to the control panel and central database 116 to indicate the start of transmission. Next, at step 1704, the pointer to the end of the log data is read and is used at step 1706 to compute the number of bytes which must be sent. At step 1708, a two byte or 16-bit number specifying the number of bytes that are to be sent is transmitted. Then at step 1710, the log information bytes are sent out sequentially, with the system waiting until the serial port is ready before sending each byte.

Figure 18:
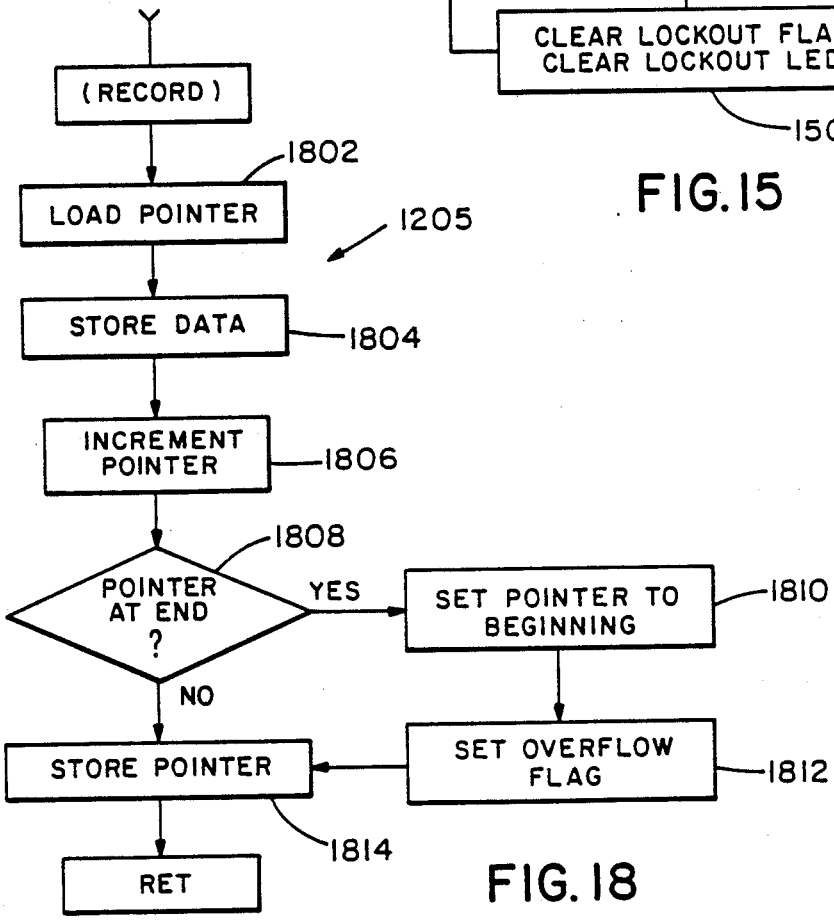

FIG. 18 presents the details of the subroutine 1205 which records data in the log table 310 (FIG. 3) or 506 (FIG. 5A) of the system 300 or the system 400. This happens following the termination of a preemption. Step 1802 retrieves the pointer to the next available entry in the log table 310 or 506. The new log entry is then stored (Step 1804), and the pointer is incremented (step 1806). At step 1808, a test is conducted to see if the pointer is at the end of the log table. If so, then at step 1810 the pointer is moved back to the beginning of the table, and an overflow flag is set (step 1812). Finally, the new value of the pointer is stored at step 1814.

The log tables 310 and 506 may be of differing sizes, so the implementations of the subroutine 1205 within the systems 300 and 400 will normally differ.

FIGS. 19 to 24 present the software details of the programming for the processor 308 within the vehicle information transmission system 300 shown in FIGS. 1 and 3.

Figure 19:
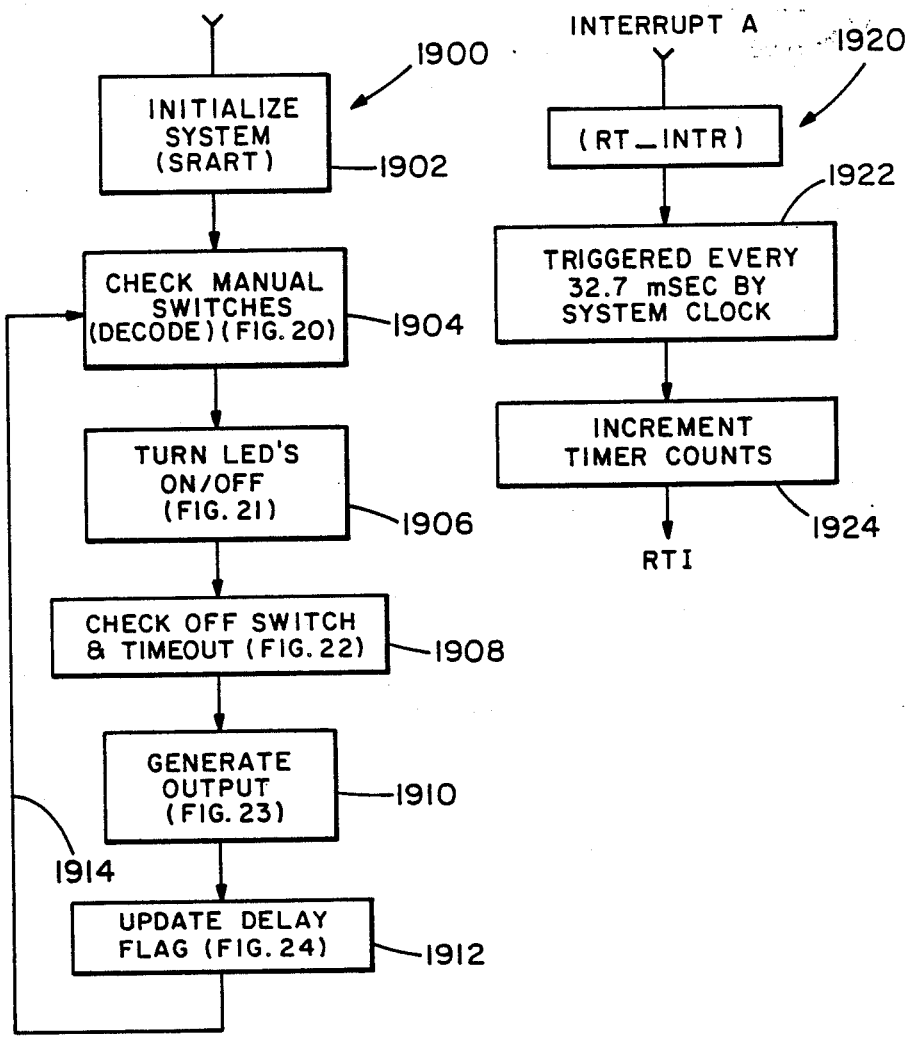
FIGS. 19 through 24 are flow diagrams of the program 1900 for the processor 308 (FIG. 3) within the vehicle information transmission system 300 (FIGS. 1 and 3).

FIG. 19 presents a block diagram overview flow diagram of the program 1900. The program 1900 begins at 1902 by initializing the system, setting up the serial ports and interrupts and taking care of other initialization tasks. A repetitive loop operation is then commenced starting with the step 1904. In step 1904, the manual switches 126 to 136 (FIGS. 1 and 3) are checked to see if their status has changed. Then at step 1906, the lamps 140 to 146, 150, and 152 (FIG. 1) are adjusted to reflect the status of the switches and the status of the vehicle information transmission system 300. Step[1908 checks to see if the off switch 136 has been pressed or if a preemption activity has timed out (lasted longer than the transmit timeout value 304 in FIGS. 1 and 3). At step 1910, a check is made to see if an output message should be sent to the directional antenna 600. If so, then a message is formulated and sent. Finally, step 1912 checks the progress of time delay tasks. The program control loops back over the path 1914 to step 1904 and recommences in a repetitive manner.

The interrupt A program at 1920 is a timer interrupt service routine which is triggered by a hardware timer every 32.7 milliseconds at step 1922. This program increments various timer counters at step 1924 within the vehicle transmission system 300 and then recommences the interrupted program.

Figure 20:
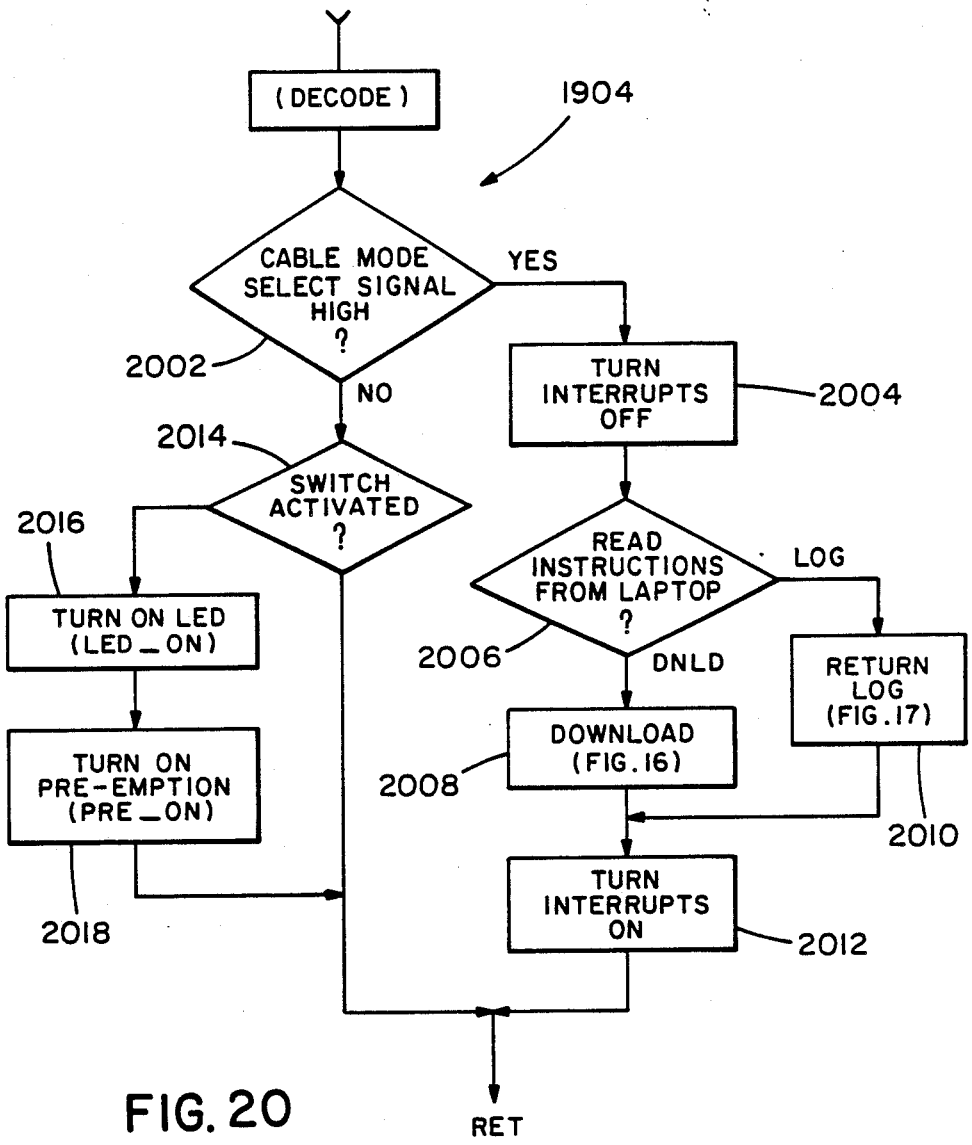

The subroutine 1904, which checks the manual switches 126–136, is presented in FIG. 20. At step 2002, the cable load select signal 329 (FIG. 3) generated by the line driver 330 is tested to see whether the control panel and central database 116 are connected to the vehicle information transmission system 300. If so, then interrupts are terminated at 2004 and the System 300 waits until the control panel and central database 116 indicates, at step 2006, whether information is to be downloaded into the vehicle transmission system 300 at 2008 or whether the logged data is to be returned at 2010. The details of these operations are set forth respectively in FIGS. 16 and 17 which were previously described.

The step 2006 can be implemented by testing for another signal in the serial I/O cable 120 or by a handshake of data passed between the control panel and central data base 116.

Figure 21:
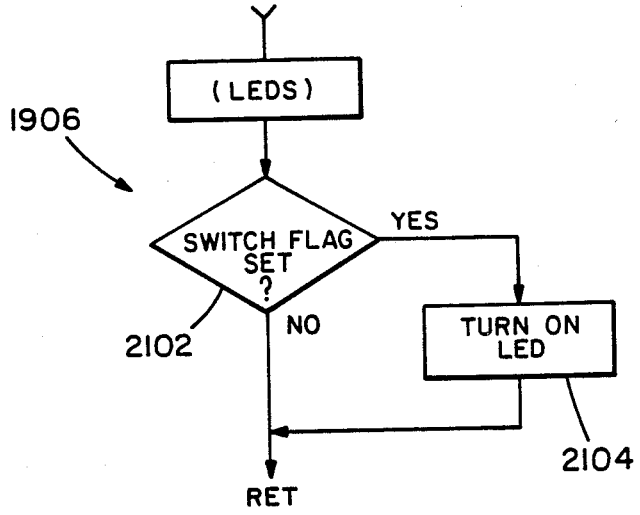

Interrupts are enabled again at step 2012, and the subroutine 1904 then terminates. When the control panel and central database 116 is not present, then program control commences with step 2014 where a test is made to see if one of the switches 126–136 has been actuated. If so, then step 2016 sets a flag to signal that the corresponding lamp 140 to 146 should be turned on by a subroutine 1906 (FIG. 21). Step 2018 initiates the preemption for the specified direction by setting the necessary flags to signal the selected or present direction and to select and initiate the time delay period which determines how long the preemption lasts if the off pushbutton 136 (FIGS. 1 and 3) is not depressed sooner.

FIG. 21 presents details of the subroutine 1906 which controls the light emitting diodes (LEDS). It checks to see if a switch illumination flag is set at 2102. If so, the step 2104 illuminates the appropriate lamp 140 to 146, 150, or 152 shown in FIG. 1.

Figure 22:
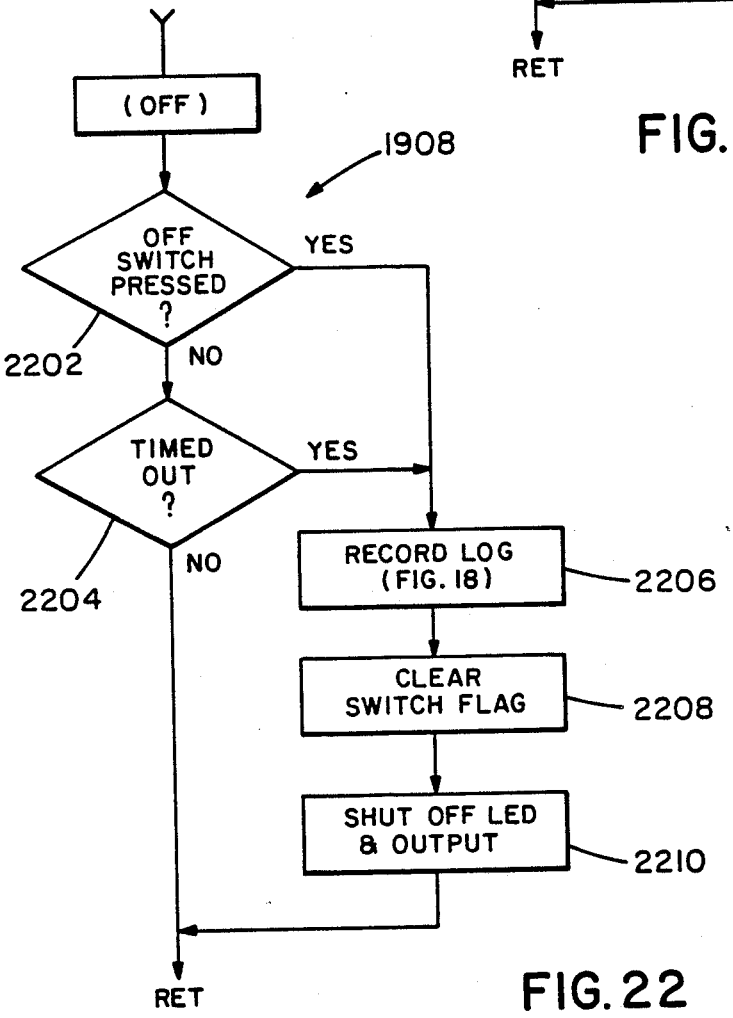

FIG. 22 illustrates the details of the subroutine 1908 which terminates a preemption. At 2202, a test is carried out to see if the off push button 136 (FIG. 1) has been depressed. If not, then at step 2204 a test is made to see if the preemption has timed out beyond the transmit timeout time 304 (FIGS. 1 and 3) that has been set up. If either of these tests comes up with a "yes" result, then at step 2206 the logging subroutine shown in FIG. 18 is actuated to log the preemption event which has just occurred in the log table 310 (FIG. 3). A preemption switch flag is then cleared at step 2208, and at step 2210 the lamp (LED) and the output message generator are shut down.

Figure 23:
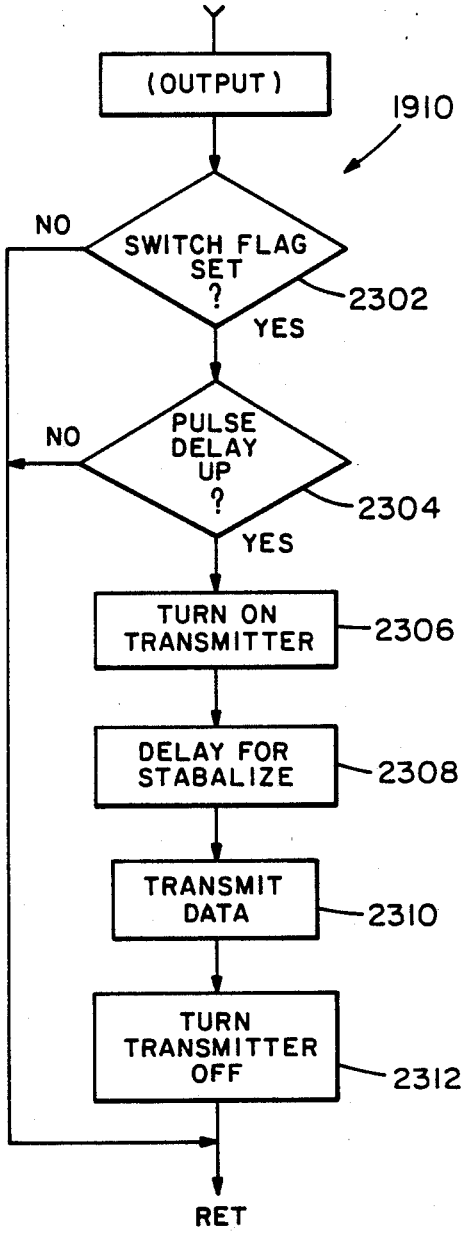

FIG. 23 discloses the details of the subroutine 1910 which generates the output messages that are provided to the direction antenna 600. The subroutine 1910 begins at step 2303 by testing a switch flag to see if any preemption is in progress. If not, the subroutine terminates. Then at step 2304, the subroutine checks to see if the pulse (or between transmission) delay time period has expired. This is the 300 millisecond (plus or minus 30 millisecond) time interval shown at the top of FIG. 2, as indicated by an internal pulse delay flag. Again, if the time period has not expired, the subroutine terminates.

The pulse delay time period includes a random, variable element to insure that two transmitters which may transmit their messages at the same time do not continue to do so for subsequent transmission. By randomly varying the delay time in each transmitter, one such simultaneous transmission would be followed by non-simultaneous transmissions. It is essential to have this or some equivalent collision avoidance mechanism to prevent two vehicles from repeatedly transmitting their messages simultaneously and thereby blocking each others transmissions from reaching the vehicle detection, identification, and preemption system 400 at a given intersection.

Assuming that it is time for a transmission, step 2306 turns on the transmitter, and then step 2308 provides a five millisecond delay 205 during which the transmitter is permitted to stabilize (see FIG. 2). At step 2310, the message bytes 206, 208, and 210 in FIG. 2 are transmitted, and then after a slight delay the transmitter is turned off at step 2312. The pulse delay counter is then reset, and then the subroutine terminates.

Figure 24:
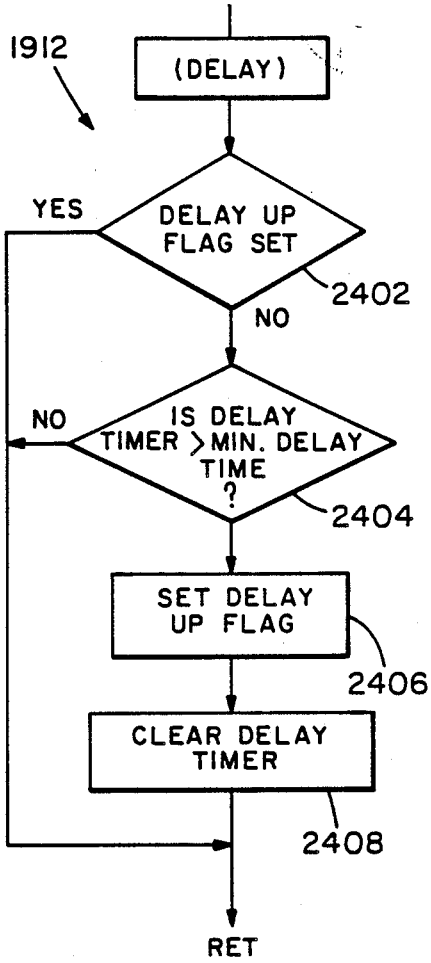

FIG. 24 sets forth the details of the delay subroutine 1912. It first checks (at 2402) to see if the delay between transmissions has already expired, as indicated by a delay up flag; and if so, then the subroutine 1912 terminates. If the delay has not expired, then at step 2404 the delay timer is compared to the minimum delay to see if the delay has expired. Again the program terminates if the timer counter has not counted passed the minimum delay time. If the timer has counted past the minimum delay time, then at step 2406 the delay up flag is set, and the delay counter is cleared at step 2408.

Program Listings

The listings that follow constitute the programming for the vehicle transmission system 300 and the vehicle detection, identification, and preemption system 400 which are used in the preferred embodiment of the invention. To the greatest extent possible, these program listings correspond to the block diagrams just presented. However, to ensure that the best mode of the invention is set forth here, the very latest versions of the programs are presented below, and these may differ in some details from the block diagrams just described. These programs are written out in the assembly language of the Motorola XC6HC11A2FN single-chip microcomputer. Information concerning the details of the assembly language from which these programs are written may be obtained from Motorola Literature Distribution, P.O. Box 20912, Phoenix, AZ 85036.

The following listing is a program design for use in conjunction with the vehicle information transition system 300.

```
        org      $ffbe    program id (2 bytes)
progid  fdb      $0102
*==================================================
*
*       program for transmitter
*       file name     : txc
*       modified date: 6-2-88
*                  by: dwj
*
*====== procedure names used
*
* delay     output   leds     stabliz  holdon  off     securty
* rtintr   ldelay  record   log      dnld     decode  getptr
* comm     setclk  readclk beep     sciwr    scird   ramtrns
* page0    page1   caddr
*
*=============================== port definitions =======
pta     equ      $1000
ptddrc  equ      $1007        * port c direction reg
ptb     equ      $1004
ptc     equ      $1003
ptd     equ      $1008
ptddrd  equ      $1009        data direction for port d
pte     equ      $100a
pttmsk1 equ      $1022        * timer int mask reg 1
pttflg2 equ      $1025        * timer int flag reg
pttmsk2 equ      $1024        * timer int mask reg 2
ptpactl equ      $1026        * port a control
ptspcr  equ      $1028        spi control register
ptspsr  equ      $1029        spi status register
ptspdr  equ      $102a        spi data register
ptbaud  equ      $102b        * sci baud rate control
ptsccr1 equ      $102c        * sci control reg 1
ptsccr2 equ      $102d        * sci control reg 2
ptscsr  equ      $102e        * sci status
ptscdr  equ      $102f        * sci data
ptpprog equ      $103b        * eeprom prog control
*== ram memory defs ======
mrt     equ      $0000        rti locations
mrtfr   equ      $0001        tenth second clock
*                               (16 bit)
mwork   equ      $0003        general work variable
mdir    equ      $0004        direction
mswtch  equ      $0005        boolean valid switch
```

```
mdlflg  equu     $0006      boolean delay up
mdelay  equ      $0007      delay work variable
*        equ      $0008
mbeep   equ      $000a      beep counter
mbdely  equ      $000b      delay between beeps
mramptr equ      $000d      pre-empt storage pointer
movf    equ      $000e      pre-empt storage overflow(0 or 1 (
mtpsr   equ      $0010      total pre-empts since reset
*                            (16 bit)
mtest   equ      $0012      test mode direction
mcable  equ      $0013      communications routine #
mspib   equ      $0020      spi buffer
******************************** user vars
usrvars equ      $0010      * number of user variables
musr1   equ      $0090      * work area in ram for ul/dl
************************     user variables
         org      $fe00
eusr1   fdb      $0258      timeout
eusr3   fcb      00
eusr4   fcb      200        stabilization time
eusr5   fcb      40         after trans time
eusr6   fcb      10         minimum multiplex time
eusr7   fcb      $80        vehicle id
eusr8   fcb      00
eusr9   fcb      00
eusr10  fcb      00
eusr11  fcb      01         security disable(boolean)
eusr12  fcb      03         security code 1
eusr13  fcb      02         security code 2
eusr14  fcb      01         security code 3
eusr15  fcb      00         security code 4
eusr16  fcb      00         test mode(boolean)
*============================== begin program ==========
         org      $f800
start    sei
         lds      #$00fd
         ldaa     #$ec
         staa     ptddrc
         clr      pta
         clr      ptb
         clr      ptc
************************
         ldx      #$0000
ram1    clr      ,x
         inx
         cpx      #$00ff
         bne      ram1
************************    * set up for rti interupt
         ldaa     #$43
         staa     pttmsk2
         staa     pttflg2
         ldaa     #$03
         staa     ptpactl
************************
         clr      ptsccr1
         ldaa     #$0c
         staa     ptsccr2
```

```
        ldaa    #$33
        staa    ptbaud
*************************   light display
lights  ldaa    #$08
l1     staa    pta
        jsr     beep
        jsr     ldelay
        clr     pta
        lsla
        cmpa    #$80
        bne     l1
************************    set up spi
        ldaa    #$3a
        staa    ptddrd
        ldaa    #$57
        staa    ptspcr
************************    set up sram recording
        jsr     getptr

        ldab    #21
        cmpb    mramptr
        bcs     spbad

        ldab    #$01
        cmpb    movf
        bcc     spramok
spbad  clr     mspib+1
        clr     mspib+2
        jsr     storptr
spramok nop
*************************
        jsr     securty
        cli
main    jsr     decode
        jsr     leds
        jsr     off
        jsr     output
        jsr     delay
        jsr     comm
        bra     main
****************************  check for cable
cableck ldaa   #$01
        staa    mcable
        pshx
        ldx     #ptb
        bclr    ,x $04
        pulx
        ldaa    pte
        anda    #$20
        beq     cabend    (no cable)
        clr     mcable
cabend  rts
****************************  laptop communications
comm    jsr     cableck
        tst     mcable
        beq     commend
```

```
commck   jsr      waitff
         ldaa     #$02        send device id
         jsr      sciwr
         ldd      progid    send prog id
         jsr      sciwr
         tba
         jsr      sciwr

commwt  jsr      cableck
         tst      mcable
         beq      commend
         ldab     ptscsr
         andb     #$20
         beq      commwt
         ldab     ptscdr    read the routine number

         cmpb     #$05        limit to 4 routines
         bcc      commend

         ldx      #commtab-2
         abx
         abx
         ldx      ,x
         jsr      ,x
         bra      commend

commtab fdb      #dnld
         fdb      #log
         fdb      #ldelay
         fdb      #setclk

commend rts
****************************   sets time out flag
*inc 1000
delay    tst      mdlflg
         bne      delend
         ldaa     mdelay
         cmpa     eusr6
         bcs      delend
         clr      mdelay
         inc      mdlflg
delend  rts
****************************
*inc 1010
output   ldaa     mswtch
         beq      outend
         ldaa     mdlflg
         beq      outend
*         sei

         ldx      #ptb
         bset     ,x $08

         jsr      stabliz
out1    ldab     ptscsr
         andb     #$80
```

```
        beq     out1
        ldab    eusr7       id code
        ora     #$80
        stab    ptscdr      transmit id code
out2    ldab    ptscsr
        andb    #$80
        beq     out2
        ldab    mdir        direction
        stab    ptscdr
out3    ldab    ptscsr
        andb    #$80
        beq     out3
        jsr     holdon
        ldx     #ptb
        bclr    ,x $08
        clr     mdlflg
        cli
outend  rts
*************************   light front led's
*inc 1020
leds    ldaa    mswtch
        beq     ledend
        ldaa    mdir
        ldab    #$08
        cmpa    #$00
        beq     ledout
        ldab    #$10
        cmpa    #$01
        beq     ledout
        ldab    #$20
        cmpa    #$02
        beq     ledout
        ldab    #$40
ledout  stab    pta
ledend  rts
*************************   transmitter stab time
stabliz pshb
        ldab    eusr4
st1     ldx     #$00ff
st2     dex
        bne     st2
        decb
        bne     st1
        pulb
        rts
*************************   transmitter hold on time
holdon  pshb
        ldab    eusr5
ho1     ldx     #$00ff
ho2     dex
        bne     ho2
        decb
        bne     ho1
        pulb
        rts
```

```
************************   security
beep     psha
         pshx
         ldx      #ptb
         bset     ,x $01
         jsr      ldelay
         bclr     ,x $01
         pulx
         pula
         rts
************************   security
*inc 1040
securty  ldaa     eusr11
         bne      secout
secstrt ldx      #eusr12
secwait ldaa     pte
         anda     #$0f
         beq      secwait
         ldab     #$03
         cmpa     #$08
         beq      sec1
         ldab     #$02
         cmpa     #$04
         beq      sec1
         ldab     #$01
         cmpa     #$02
         beq      sec1
         ldab     #$00
         cmpa     #$01
sec1    jsr      beep
sec2    ldaa     pte
         anda     #$0f
         bne      sec2
         cmpb     ,x
         bne      secstrt    bad key
         inx
         cpx      #eusr12+4
         bne      secwait
secout  clr      ptb
         ldaa     #$ff
         staa     pta
         ldaa     #$06
seddly  jsr      ldelay
         deca
         bne      seddly
         clr      pta
secend  rts
************************   decode dir switches
*inc 1050
decode   ldaa     pte       if switch pressed, set mdir to dir
         anda     #$0f       and mswtch to ff
         beq      dcend
         ldab     #$03
         cmpa     #$08
         beq      dcout
```

```
        decb
        cmpa    #$04
        beq     dcout
        decb
        cmpa    #$02
        beq     dcout
        decb
        cmpa    #$01
        bne     dcend
dcout   pshb
        ldaa    mswtch
        beq     dcnew
        bsr     offout
dcnew   pulb
        stab    mdir
        ldab    #$ff
        stab    mswtch
        ldaa    #$0c
        staa    ptc
        clr     mrtfr
        clr     mrtfr+1
        clr     mbeep
        ldaa    #$25
        staa    mbdely
        ldaa    #$05

        sei
dcout1  ldab    ptb     chirping
        eorb    #$01
        stab    ptb
        ldx     #$2fff
dcout2  dex
        bne     dcout2
        inca
        cmpa    #$15
        bne     dcout1
        cli

dcend   ldaa    eusr16  test mode
        beq     dcexit
        ldaa    mrtfr
        anda    #$01
        beq     dcexit
        ldab    mtest
        incb
        andb    #$03
        stab    mtest
        bra     dcout
dcexit  rts
************************   check off switch and timeout
*inc 1030
off     ldaa    mswtch
        beq     offend

        ldaa    pte     (off switch)
```

```
        bmi     offout

        ldx     eusr1
        beq     offend
        ldd     mrtfr     (timeout)
        subd    eusr1
        bmi     offend

offout  jsr     record    this routine may be called!
        clr     mswtch
        clr     pta
        clr     ptc
        clr     ptb       turn tm and audio off
        clr     mbeep
offend  rts
*********************** real time interupt
*inc 100
rtintr  inc     mrt
        ldaa    mrt
        cmpa    #$03        tenth second
        bne     rtend
        inc     mdelay
        clr     mrt
        inc     mbeep
        ldx     mrtfr
        inx
        stx     mrtfr

rt1     ldaa    mswtch
        bne     rt2

        bra     rtend

rt2     ldaa    mbeep
        cmpa    mbdely
        bmi     rtend

        clr     mbeep
        ldaa    ptb
        ora     #$01
        staa    ptb
        jsr     ldelay
        anda    #$fe
        staa    ptb
        ldd     mrtfr    step up beep
        addd    #$002f
        subd    eusr1
        bmi     rtend
        ldaa    #$01
        staa    mbdely

rtend   ldaa    #$40
        staa    pttflg2
        rti
**************************
```

```
ldelay  pshx
         ldx      #$ffff        subroutine for long delay
ldel1   dex
         bne      ldel1
         pulx
         rts
*************************   records preemption data
*inc 70
record   ldy      mtpsr
         iny
         sty      mtpsr

         jsr      getptr
         jsr      readclk
         ldaa     mspib+5 month
         staa     mspib+3
         ldaa     mspib+1 minutes
         staa     mspib+6
         ldaa     mspib+2 hours
         anda     #$3f
         staa     mspib+5

         ldd      mrtfr    compute tenth minutes
         pshx
         ldx      #$003c     (60)
         idiv
         xgdx
         pulx

rec1    lslb
         lslb
         orb      mdir
         stab     mspib+2
         ldaa     eusr7   (id)
         staa     mspib+1

rec2    ldab     mramptr    store data
         bsr      caddr      calculate address
         orb      #$80
         stab     mspib

         ldab     #$07
         jsr      ramtrns

         inc      mramptr    increment pointer
         ldaa     mramptr
         cmpa     #41
         bcs      recstr
         clr      mramptr
         ldaa     #$01
         staa     movf
recstr  jsr      storptr
         rts
*************************   calculate address in b
caddr   jsr      page0     result in a and b
```

```
          cmpb     #21          selects memory page
          bcs      cout
          jsr      page1
          subb     #21
cout     ldaa     #$06
          mul
          rts
*************************      output recorded data
*inc 40
log       sei
          jsr      waitff
          jsr      sendff
          jsr      getptr
          ldaa     eusr7
          jsr      sciwr
          ldaa     mtpsr       output total pre-empts
          jsr      sciwr
          ldaa     mtpsr+1
          jsr      sciwr

          tst      movf
          beq      lognovf
          ldab     #40
          stab     mramptr
lognovf clra
          jsr      sciwr
          ldaa     mramptr
          jsr      sciwr       number of pre-empts
          tsta
          beq      logend

          clrb
lognext pshb
          jsr      caddr       convert b to address
          stab     mspib
          ldab     #$07
          jsr      ramtrns
          pulb
          ldx      #mspib+1
log1     ldaa     ,x
          jsr      sciwr
          inx
          cpx      #mspib+7
          bne      log1
          incb
          cmpb     mramptr
          bcs      lognext

logend   clr      mramptr
          clr      movf
          jsr      storptr
          rts
**************************w
waitff   jsr      cableck
          tst      mcable
```

```
          beq      wtffend
          ldaa     ptscsr    scird    wait for start
          anda     #$20
          beq      waitff
          ldaa     ptscdr
          cmpa     #$ff
          bne      waitff
wtffend rts
**************************
sendff  ldaa     #$ff    signal start of trans
          jsr      sciwr
          rts
**************************
setclk  jsr      waitff
          jsr      sendff
          jsr      readclk

          ldx      #mspib+1 send out sci
setul   ldaa     ,x
          jsr      sciwr
          inx
          cpx      #mspib+7
          bne      setul

          ldaa     #$a1     read new time from sci
          staa     mspib
          ldx      #mspib+1
setdl   jsr      scird
          staa     ,x
          inx
          cpx      #mspib+7
          bne      setdl

          ldab     #$07
          bsr      clktrns

          ldd      #$b1b0    start clock
          std      mspib
          ldab     #$02
          bsr      clktrns
          rts
**************************
readclk pshx
          ldaa     #$21
          staa     mspib     read code
          ldab     #$07
          bsr      clktrns
          pulx
          rts
**************************  transfers the # of bytes in b
clktrns ldx      #ptb
          bset     ,x $10
          bsr      spitrns
          rts
**************************  gets ram pointer & ovf
```

```
getptr  bsr      page0
         ldaa     #$7e      address in sram
         staa     mspib
         ldab     #$03
         bsr      ramtrns
         ldaa     mspib+1
         staa     mramptr
         ldaa     mspib+2
         staa     movf
         rts
***************************  stores ram pointer & ovf
storptr bsr      page0
         ldaa     mramptr
         staa     mspib+1
         ldaa     movf
         staa     mspib+2
         ldaa     #$fe      address in sram
         staa     mspib
         ldab     #$03
         bsr      ramtrns
         rts
***************************  selects page in sram
page0   clr      mspib
         bra      pageout
page1   clr      mspib
         inc      mspib
pageout ldab     #$01
         bsr      ramtrns
         rts
***************************  transfers the # of bytes in b
ramtrns ldx      #ptb
         bset     ,x $20
         bsr      spitrns
         rts
***************************  transfers the # of bytes in b
spitrns psha
         ldx      #mspib
spi1    ldaa     ,x
         staa     ptspdr
spiwt   tst      ptspsr
         bpl      spiwt
         ldaa     ptspdr
         staa     ,x
         inx
         decb
         bne      spi1
         ldx      #ptb
         bclr     ,x $30   deselect both
         pula
         rts
***************************
*inc 160
sciwr   staa     ptscdr
sciw1   tst      ptscsr
         bpl      sciw1
```

```
          jsr      ldelay
          rts
*************************
scird    ldaa     ptscsr
          anda     #$20
          beq      scird
          ldaa     ptscdr
          rts
*************************
dnld      sei
          ldaa     #$78
          staa     pta

          jsr      waitff
          jsr      sendff
          ldd      #usrvars   number of bytes
          bsr      sciwr
          tba

          ldx      #eusr1
          ldab     #usrvars+1
dnnext   jsr      sciwr
          ldaa     ,x
          inx
          decb
          bne      dnnext

          ldx      #musr1
          ldab     #usrvars

upld      jsr      waitff

upld1     jsr      scird
          staa     ,x
          inx
          decb
          bne      upld1

          clr      pta

copydn   ldx      #eeclear  * copy program to ram
          ldy      #$0000
cdn1     ldaa     ,x
          staa     ,y
          inx
          iny
          cpx      #eeclear+$70 (length of routine)
          bne      cdn1
          jmp      $0000
*************************  copy from ram to eeprom
eeclear lds      #$00fd
          ldx      #eusr1      eeprom erasure
ee1      ldaa     #$16
          staa     ptpprog
          staa     ,x
```

```
          inca
          staa      ptpprog
          bsr       delay10
          inx
          cpx       #eusr1+usrvars
          bne       ee1
*************************   copy from ram to eeprom
copyup  ldx       #musr1       ram to copy from
          ldy       #eusr1       eeprom to copy to
cup1    ldab      #02
          stab      ptpprog
          ldaa      ,x
          staa      ,y
          incb
          stab      ptpprog
          bsr       delay10
          clr       ptpprog
          inx
          iny
          cpx       #musr1+usrvars
          bne       cup1
          swi
*************************      10 ms delay
delay10   psha
          ldaa      #$0a
          clrb
eedel   incb
          bne       eedel
          deca
          bne       eedel
          pula
          rts
*************************
          org       $ffd4
          fdb       start    res
          fdb       start    sci
          fdb       start    paie
          fdb       start    paie
          fdb       start    pao
          fdb       start    to
          fdb       start    toc5
          fdb       start    toc4
          fdb       start    toc3
          fdb       start    toc2
          fdb       start    toc1
          fdb       start    tic3
          fdb       start    tic2
          fdb       start    tic1
          fdb       rtintr  rti
          fdb       start    irq
          fdb       start    xirq
          fdb       start    swi
          fdb       start    ioc
          fdb       start    cop
          fdb       start    copcm
```

```
        fdb      start
```

The following program listing is design for use in the vehicle detection, identification, and preemption system 400.

```
        org      $ffbe    program id (2 bytes)
progid  fdb      $0100
*=================================================
*
*       program for 160cr micro
*       file name     : rx
*       modified date: 6-6-88
*                  by: dwj
*====== procedure names used
*
* ldelay  decode    log      newpr    cancel   record   recall
* rtintr  sciintr   setx     updated  clear    preon    preoff tb:
* clrline setclk    readclk  dnld     sciwr    scird    comm     s
* dgtest  waitff    sendff   spitrns  ramtrns clktrns page0   pag
* getptr  caddr
*================================ port definitions =======
*
*= port definitions ======
pta     equ      $1000
ptddrc  equ      $1007       port c direction reg
ptc     equ      $1003
ptb     equ      $1004
ptd     equ      $1008
ptddrd  equ      $1009
pte     equ      $100a
pttmsk1 equ      $1022       timer int mask reg 1
pttflg2 equ      $1025       timer int flag reg
pttmsk2 equ      $1024       timer int mask reg 2
ptpactl equ      $1026       port a control
ptspcr  equ      $1028       spi control register
ptspsr  equ      $1029       spi status register
ptspdr  equ      $102a       spi data register
ptbaud  equ      $102b       sci baud rate control
ptsccr1 equ      $102c       sci control reg 1
ptsccr2 equ      $102d       sci control reg 2
ptscsr  equ      $102e       sci status
ptscdr  equ      $102f       sci data
ptadctl equ      $1030       a/d control / status
ptadr1  equ      $1031       a/d result 1
ptoptn  equ      $1039       system configuration options
ptpprog equ      $103b       eeprom prog control
*== ram memory defs ======
mrt     equ      $0000       rti locations
mrtfr   equ      $0001       free running 1/2 second clock
*                              (16 bit counter)
mrtcl   equ      $0003       last time the block cleared
************************
```

```
mwork    equ      $0004      general work variable
mdgtest  equ      $0005      for diagnostic test
mramptr  equ      $0006      next pre-empt number
movf     equ      $0007      pre-empt overflow(boolean)
mscib1   equ      $0008      sci input buffers
mscib2   equ      $0009
mcancel  equ      $000b      cancel routine flag
mcable   equ      $000c      cable present(boolean)
mtpsr    equ      $000d      total pre-empts since reset
*                            (16 bit)
mlvid    equ      $000f      last vid
mldir    equ      $0010      last direction
mlsig    equ      $0011      last signal strength
mpip     equ      $0012      pre-emption in progress(boolean)
mcomm    equ      $0013      laptop communication flag
mspib    equ      $0020      spi buffer (16 bytes)
************************
*inc 10
mblock   equ      $0030      directional array $20 to $5f
preempt   equ      $0000      signal active(00,01) disp
number    equ      $0002      number of pulses disp
ftime     equ      $0003      first time disp
ltime     equ      $0005      last time disp
tactive  equ      $0007      time preempt went active disp
id        equ      $0009      vehicle id code disp
index     equ      $000a      index of record disp(16 bit)
lockout   equ      $000c      lockout disp(0,1)
dirblck  equ      $0010      displacement between blocks
************************     user variables
usrvars  equ      $0030      number of user variables
musr1    equ      $0090      work area in ram for ul/dl
*inc 20
          org      $fe00
eusr1    fcb      $7f     usr1      clear out time
eusr2    fcb      $02     usr2      number pulses to turn on
eusr3    fdb      $0032   usr3,4    signal loss time out (16 bi
eusr5    fdb      $0050   usr5,6    minimum preempt time dur (1
eusr7    fdb      $00ff   usr7,8    lockout time (16 bit)
eusr9    fdb      $00f0   usr9,10   free lock time (16 bit)
eusr11   fcb      $0f     usr11     recall for 0 (0f for no rec
eusr12   fcb      $0f     usr12     recall for 1 (0f for no rec
eusr13   fcb      $0f     usr13     recall for 2 (0f for no rec
eusr14   fcb      $0f     usr14     recall for 3 (0f for no rec
eusr15   fcb      $04     usr15     minimum signal level
eusr16   fcb      $00     usr16     reciever id
eusr17   fcb      $00     usr17     only 1 pre-empt
eusr18   fcb      $00
eusr19   fcb      $00
eusr20   fcb      $00
eusr21   fcb      $00
eusr22   fcb      $00
eusr23   fcb      $00
eusr24   fcb      $00
eusr25   fcb      $00
eusr26   fcb      $00
```

```
eusr27  fcb     $00
eusr28  fcb     $00
eusr29  fcb     $00
eusr30  fcb     $00
eusr31  fcb     $00
eusr32  fcb     $00
vidluts equ     $20                 size of id table
eusr33  fcb     $80     usr32-63    valid id list
eusr34  fcb     247
eusr35  fcb     $00
eusr36  fcb     $00
eusr37  fcb     $00
eusr38  fcb     $00
eusr39  fcb     $00
eusr40  fcb     $00
eusr41  fcb     $00
eusr42  fcb     $00
eusr43  fcb     $00
eusr44  fcb     $00
eusr45  fcb     $00
eusr46  fcb     $00
eusr47  fcb     $00
eusr48  fcb     $00
eusr49  fcb     $00
eusr50  fcb     $00
eusr51  fcb     $00
eusr52  fcb     $00
eusr53  fcb     $00
eusr54  fcb     $00
eusr55  fcb     $00
eusr56  fcb     $00
eusr57  fcb     $00
eusr58  fcb     $00
eusr59  fcb     $00
eusr60  fcb     $00
eusr61  fcb     $00
eusr62  fcb     $00
eusr63  fcb     $00
eusr64  fcb     $00
*============================== begin program ==========
        org     $f800
start   sei
        lds     #$00fd
        ldaa    #$ff
        staa    ptddrc
        clr     pta
        clr     ptb
        clr     ptc
***************************   light display
        clrb
lights  jsr     ldelay
        com     pta
        incb
        cmpb    #$08
        bne     lights
```

```
*************************    set up a/d
        ldaa    #$80
        staa    ptoptn
        ldaa    #$20
        staa    ptadctl
*************************    set up for rti interupt
        ldaa    #$43
        staa    pttmsk2
        staa    pttflg2
        ldaa    #$03
        staa    ptpactl
*************************    set up for sci interupt
        clr     ptsccr1
        ldaa    #$33
        staa    ptbaud
        cli
************************     set up spi
        ldaa    #$3a
        staa    ptddrd
        ldaa    #$57
        staa    ptspcr
************************
ramclr  ldx     #$00ff
ram1    clr     ,x
        dex
        bne     ram1
************************     set up sram recording
        jsr     getptr
        ldd     mramptr
        cmpa    #$21
        bcc     spbad
        cmpb    #$02
        bcc     main
spbad   clr     mspib+1
        clr     mspib+2
        jsr     storptr
**************************  main program
main    nop
        jsr     decode
        jsr     updated
        jsr     cancel
        jsr     newpr
        jsr     clear
        jsr     unlock
        jsr     comm
        ldaa    ptoptn
        jmp     main
*************************   subroutine for long delay
ldelay  pshx
        ldx     #$0000
ldel1   dex
        bne     ldel1
        pulx
        rts
****************************  check for cable
```

```
cableck ldaa    #$01
        staa    mcable
        pshx
        ldx     #ptd
        bclr    ,x $20
        pulx
        ldaa    pte
        anda    #$04
        beq     cabend     (no cable)
        clr     mcable
        clr     mcomm
cabend  rts
****************************  laptop communications
comm    jsr     cableck
        tst     mcable
        beq     commend

        ldaa    #$0c       disable modem interupt
        staa    ptsccr2
        ldab    #$01       select db9
        jsr     selsrc

commjmp ldab    mcomm
        beq     commck

        ldx     #commtab-2
        abx
        abx
        ldx     ,x
        jsr     ,x
        bra     commend

commtab fdb     #dnld
        fdb     #log
        fdb     #dgtest
        fdb     #setclk

commck  jsr     waitff
        ldaa    #$01       send device id
        jsr     sciwr
        ldd     progid     send prog id
        jsr     sciwr
        tba
        jsr     sciwr

commwt  jsr     cableck
        tst     mcable
        beq     commend
        ldaa    ptscsr
        anda    #$20
        beq     commwt
        ldaa    ptscdr     read the routine number

        cmpa    #$05       limit to 4 routines
        bcc     commend
```

```
        staa    mcomm
        bra     commjmp

commend clrb                    select modem
        jsr     selsrc
        ldaa    #$2c            enable modem interupt
        staa    ptsccr2
        rts
*************************       decode switches and switch on pre
*inc 30
decode  ldaa    pta
        anda    #$87
        beq     dcend
dccont  ldab    #$03
        cmpa    #$80
        beq     dcout
        decb
        cmpa    #$04
        beq     dcout
        decb
        cmpa    #$02
        beq     dcout
        clrb
        cmpa    #$01
        bne     dcend
dcout   jsr     preon
dcend   rts
**************************      output recorded data
*inc 40
log     sei
        jsr     waitff
        jsr     sendff
        jsr     getptr
        ldaa    eusr7
        jsr     sciwr
        ldaa    mtpsr           output total pre-empts
        jsr     sciwr
        ldaa    mtpsr+1
        jsr     sciwr

        tst     movf
        beq     lognovf
        ldab    #40
        stab    mramptr
lognovf clra
        jsr     sciwr
        ldaa    mramptr
        jsr     sciwr           number of pre-empts
        tsta
        beq     logend

        clrb
lognext pshb
        jsr     caddr           convert b to address
        stab    mspib
```

```
         ldab     #$07
         jsr      ramtrns
         pulb
         ldx      #mspib+1
log1    ldaa     ,x
         jsr      sciwr
         inx
         cpx      #mspib+7
         bne      log1
         incb
         cmpb     mramptr
         bcs      lognext

logend  clr      mramptr
         clr      movf
         jsr      storptr
         clr      mcomm
         rts
***************************   calculate address in b
caddr   pshb
         jsr      page0     result in a and b
         pulb
         cmpb     #21        selects memory page
         bcs      cout
         jsr      page1
         subb     #21
cout    ldaa     #$06
         mul
         rts
***************************  gets ram pointer & ovf
getptr  bsr      page0
         ldaa     #$7e      address in sram
         staa     mspib
         ldab     #$03
         bsr      ramtrns
         ldd      mspib+1  (ramptr and ovf)
         std      mramptr
         rts
***************************  stores ram pointer & ovf
storptr bsr      page0
         ldd      mramptr  (ramptr and ovf)
         std      mspib+1
         ldaa     #$fe      address in sram
         staa     mspib
         ldab     #$03
         bsr      ramtrns
         rts
***************************  selects page in sram
page0   clr      mspib
         bra      pageout
page1   clr      mspib
         inc      mspib
pageout ldab     #$01
         bsr      ramtrns
         rts
```

```
*************************  transfers the # of bytes in b
ramtrns ldx      #ptc
         bset     ,x $20
         jsr      spitrns
         rts
*************************
*inc 50
newpr   tst      eusr17      only 1 pre-empt
         beq      new1
         tst      mpip        pre-empt in progress
         bne      newend
new1    clrb
new2    jsr      setx
         tst      preempt,x
         bne      newnext

         tst      lockout,x
         bne      newnext

         ldaa     number,x
         suba     eusr2
         bcs      newnext
         inc      preempt,x    issue preemption

         ldy      mrtfr
         sty      tactive,x
         inc      mpip
         jsr      preon
         ldx      mtpsr       index register lost!
         inx
         stx      mtpsr
newnext incb
         cmpb     #$04
         bne      new2
newend  rts
*************************   this routine cancels preemption
*inc 60
cancel   tst      mcancel
         beq      canend
         clr      mcancel
         clrb
can1    jsr      setx
         tst      preempt,x
         bne      canlout
         jsr      preoff         (no preempt)
         bra      cannext

canlout tst      lockout,x        ingnore if locked out
         bne      cannext

         pshb                      check minimum timeout
         ldd      mrtfr
         subd     tactive,x
         subd     eusr5
         pulb
```

```
        bmi     cannext

        pshb                        check loss of signal timeout
        ldd     mrtfr
        subd    ltime,x
        subd    eusr3
        pulb
        bmi     can2
        clr     number,x
        bra     canclr

can2    pshb
        ldd     mrtfr
        subd    ftime,x
        subd    eusr7       check max time
        pulb
        bmi     cannext
        inc     lockout,x   mark lockout
        ldy     #ptc
        bset    ,y #$04

canclr  jsr     record
        clr     preempt,x
        jsr     recall
        jsr     preoff
        clr     mpip

cannext incb
        cmpb    #$04
        bne     can1
canend  rts
*************************   records preemption data
record  pshb
        pshx
        stab    mwork (direction)

        ldy     mtpsr
        iny
        sty     mtpsr

        jsr     getptr
        jsr     readclk
        ldaa    mspib+5 month
        staa    mspib+3
        ldaa    mspib+1 minutes
        staa    mspib+6
        ldaa    mspib+2 hours
        anda    #$3f
        staa    mspib+5

        pulx
        pshx
        ldaa    id,x            (id)
        staa    mspib+1
```

```
        ldd     mrtfr     compute tenth minutes
        subd    tactive,x
        ldx     #$003c      (60)
        idiv
        xgdx


rec1    lslb
        lslb
        orab    mwork         (dir)
        stab    mspib+2

rec2    ldab    mramptr     store data
        jsr     caddr       calculate address
        orb     #$80
        stab    mspib

        ldab    #$07
        jsr     ramtrns

        inc     mramptr     increment pointer
        ldaa    mramptr
        cmpa    #41
        bcs     recstr
        clr     mramptr
        ldaa    #$01
        staa    movf
recstr  jsr     storptr
        pulx
        pulb
        rts
*************************   this routine checks for recall
*inc 80
recall  pshb                sets up recall for dir in b
        ldaa    id,x
        cmpa    #$01        (see if recall)
        beq     recend
        ldx     #eusr11     base of recall lut
        andb    #$03
        abx
        ldab    ,x
        cmpb    #$0f        no recall
        beq     recend
        jsr     setx
        ldaa    #$01
        staa    id,x
        ldaa    #$1f
        staa    number,x    (set count high)
recend  pulb
        rts
*************************   this routine cancels lockout
*inc 90
unlock  clrb
unl     jsr     setx
        tst     lockout,x
```

```
        beq     unnext

        pshb
        ldd     mrtfr
        subd    ltime,x
        subd    eusr9      free lock time
        pulb
        bmi     unnext
        jsr     clrline
        ldx     #ptc
        bclr    ,x $04

unnext  incb
        cmpb    #$04
        bne     un1
        rts
*************************  diagnostic
dgtest  ldaa    #$10
        cmpa    mdgtest
        bcc     dgend
        clr     mdgtest
        ldaa    #$ff
        jsr     sciwrf
        ldaa    mlvid     last vid
        jsr     sciwrf
        ldaa    mldir     last dir
        jsr     sciwrf
        ldaa    mlsig     last signal strength
        jsr     sciwrf
dgend   rts
*************************  real time interupt
*inc 100
rtintr  inc     mrt
        ldaa    mrt

        cmpa    #$03       1/10 second
        bne     rtend
        inc     mdgtest
        inc     mcancel
        clr     mrt
        ldx     mrtfr     increment free running clock
        inx
        stx     mrtfr

        ldx     #ptc     turn signal light off
        bclr    ,x $08

        ldaa    mrtfr     prevent overflow
        bpl     rtend
        ldaa    mblock
        bne     rtend
        ldaa    mblock+dirblck
        bne     rtend
        ldaa    mblock+dirblck+dirblck
        bne     rtend
```

```
          ldaa      mblock+dirblck+dirblck+dirblck
          bne       rtend
          clr       mrtfr
          clr       mrtfr+1

rtend    ldaa      #$40
          staa      pttflg2
          rti
***************************   sci interupt routine
*inc 110
sciintr ldaa      ptscsr      this routine places the
          anda      #$26          byte string in buffer
          cmpa      #$20
          bne       scibad
          ldab      eusr15
          beq       sciok

          ldaa      ptadr1      check signal level
          sba
          bcs       scibad
          staa      mlsig

sciok    ldaa      ptscdr
          bpl       sciadd
          staa      mscib1      store first byte
          ldaa      #$ff         flag second as empty
sciadd   staa      mscib2
          ldx       #ptc        data light
          bset      ,x #$08
sci1     rti
scibad   ldaa      ptscdr
          clr       mscib1
          rti
*************************     table lookup
*inc 140
tbllu    pshb                   vid sent in a, 0 or vid returned
          pshx
          clrb
          ldx       #eusr33
tbl1     cmpa      ,x
          beq       tblval
          inx
          incb
          cmpb      #vidluts
          bne       tbl1
          clra
tblval   pulx
          pulb
          rts
*************************   set index register
*inc 120
setx     psha
          pshb
          clra
          andb      #$03
```

```
         incb
         xgdx
         ldd      #mblock-dirblck
setx1   addd     #dirblck
         dex
         bne      setx1
setxend xgdx
         pulb
         pula
         rts
*************************   update direction array
*inc 130
updated sei
         tst      mscib1
         bmi      upcont
upquit  cli
         rts
upcont  tst      mscib2
         bmi      upquit
         ldd      mscib1
         staa     mldir
         stab     mlvid   *
         psha               *
         ldaa     #$ff        * read sci buffer
         sta      mscib2     *
         clr      mscib1    *
         cli               *
         pula            *
         jsr      setx
         jsr      tbllu
         tsta
         beq      upend
         staa     id,x
         inc      number,x
         ldy      mrtfr
         sty      ltime,x
         ldd      ftime,x
         bne      upend
         sty      ftime,x
upend   rts
*************************     clear block
*inc 150
clear    ldaa     mrtfr+1
         suba     mrtcl
         cmpa     eusr1
         bcs      clend
         ldaa     mrtfr+1
         staa     mrtcl

         clrb                clear routine clears out
cl1     jsr      setx       blocks of the dir block
         tst      preempt,x  that are not in preemption
         bne      clnext
         tst      lockout,x  check for lockout
         bne      clnext
```

```
         jsr      clrline
clnext  incb
         cmpb     #$04
         bne      cl1
clend   rts
*************************
preon   ldx      #prelut    turns on the preempt for
         andb     #$03        the direction in b
         abx
         ldaa     ,x
         oraa     ptb
         staa     ptb

         ldx      #ledlut    turns on the led
         abx
         ldaa     ,x
         oraa     pta
         staa     pta
         rts
*************************
preoff  ldx      #prelut    turns off the pre for
         andb     #$03        the direction in b
         abx
         ldaa     ,x
         coma
         anda     ptb
         staa     ptb

         ldx      #ledlut    turns off the led
         abx
         ldaa     ,x
         coma
         anda     pta
         staa     pta
         rts
*************************   clears 1 line in block
clrline pshx
         clra
clr1    clr      ,x
         inx
         inca
         cmpa     #dirblck
         bne      clr1
         pulx
         rts
*************************
setclk  jsr      waitff
         jsr      ldelay
         jsr      sendff
         jsr      readclk

         ldx      #mspib+1   send out sci
setul   ldaa     ,x
         jsr      sciwr
         inx
```

```
        cpx     #mspib+7
        bne     setul

        ldaa    #$a1        read new time from sci
        staa    mspib
        ldx     #mspib+1
setdl   jsr     scird
        staa    ,x
        inx
        cpx     #mspib+7
        bne     setdl

        ldab    #$07
        bsr     clktrns

        ldd     #$b1b0      start clock
        std     mspib
        ldab    #$02
        bsr     clktrns

        clr     mcomm
        rts
***************************
readclk pshx
        ldaa    #$21
        staa    mspib       read code
        ldab    #$07
        bsr     clktrns
        pulx
        rts
***************************  transfers the # of bytes in b
clktrns ldx     #ptc
        bset    ,x $10
        bsr     spitrns
        rts
***************************  transfers the # of bytes in b
spitrns psha
        ldx     #mspib
spi1    ldaa    ,x
        staa    ptspdr
spiwt   tst     ptspsr
        bpl     spiwt
        ldaa    ptspdr
        staa    ,x
        inx
        decb
        bne     spi1
        ldx     #ptc
        bclr    ,x $30      deselect both
        pula
        rts
***************************w
waitff  jsr     cableck
        tst     mcable
        beq     wtffend
```

```
        ldaa    ptscsr    scird    wait for start
        anda    #$20
        beq     waitff
        ldaa    ptscdr
        cmpa    #$ff
        bne     waitff
wtffend rts
**************************
sendff  ldaa    #$ff    signal start of trans
        jsr     sciwr
        rts
*************************
sciwr   jsr     sciwrf
        jsr     ldelay
        rts
************************* full speed sci write
sciwrf  staa    ptscdr
sciwrf1 tst     ptscsr
        bpl     sciwrf1
        rts
*************************
scird   ldaa    ptscsr
        anda    #$20
        beq     scird
        ldaa    ptscdr
        rts
*************************  select sci device b=0,modem b=1,db9
selsrc  ldx     #ptc
        bclr    ,x #$03
        tstb
        beq     selend
        bset    ,x #$01
selend  rts
*************************
dnld    sei
        ldaa    #$78
        staa    pta

        jsr     waitff
        jsr     sendff
        ldd     #usrvars   number of bytes
        bsr     sciwr
        tba

        ldx     #eusr1
        ldab    #usrvars+1
dnnext  jsr     sciwr
        ldaa    ,x
        inx
        decb
        bne     dnnext

        ldx     #musr1
        ldab    #usrvars
upld    jsr     waitff
```

```
upld1    jsr      scird
         staa     ,x
         inx
         decb
         bne      upld1

         clr      pta

copydn  ldx      #eeclear  copy program to ram
         ldy      #$0000
cdn1    ldaa     ,x
         staa     ,y
         inx
         iny
         cpx      #eeclear+$70 (length of routine)
         bne      cdn1
         jmp      $0000
*************************  copy from ram to eeprom
eeclear lds      #$00fd
         ldx      #eusr1      eeprom erasure
ee1     ldaa     #$16
         staa     ptpprog
         staa     ,x
         inca
         staa     ptpprog
         bsr      delay10
         inx
         cpx      #eusr1+usrvars
         bne      ee1
*************************   copy from ram to eeprom
copyup  ldx      #musr1       ram to copy from
         ldy      #eusr1       eeprom to copy to
cup1    ldab     #02
         stab     ptpprog
         ldaa     ,x
         staa     ,y
         incb
         stab     ptpprog
         bsr      delay10
         clr      ptpprog
         inx
         iny
         cpx      #musr1+usrvars
         bne      cup1
         swi
*************************      10 ms delay
delay10  psha
         ldaa     #$0a
         clrb
eedel   incb
         bne      eedel
         deca
         bne      eedel
         pula
         rts
*************************
```

```
ledlut  fdb      $0810
         fdb      $2040
prelut  fdb      $0102
         fdb      $0408
*************************)
*************************
         org      $ffd4
         fdb      start       res
         fdb      sciintr    sci
         fdb      start       spi
         fdb      start       paie
         fdb      start       pao
to       fdb      start
toc5     fdb      start
toc4     fdb      start
toc3     fdb      start
toc2     fdb      start
toc1     fdb      start
tic3     fdb      start
tic2     fdb      start
tic1     fdb      start
rti      fdb      rtintr
irq      fdb      start
xirq     fdb      start
swi      fdb      start
ioc      fdb      start
cop      fdb      start
copcm    fdb      start
reset    fdb      start
```

What is claimed is:

1. A traffic signal preemption system for enabling emergency vehicles to cause a traffic light controller at an intersection to preempt traffic signals at the intersection in favor of emergency vehicles, said system comprising:

a vehicle information transmission system installed in at least one emergency vehicle and including directional transmission means actuatable by the vehicle's occupants for generating information identifying said at least one emergency vehicle and for repeatedly transmitting said information, encoded into repeatedly transmitted vehicle identification signals, in the direction of vehicular motion;

a vehicle detection, identification, and preemption system connecting to at least one traffic light controller, said detection, identification, and preemption system including radio signal receiving means for receiving vehicle identification signals from said at least one emergency vehicle and for extracting information identifying the emergency vehicle therefrom, said radio receiving means including gain control means for producing a signal level signal indicative of the strength of said vehicle identification signals, and processing means for determining, based upon said received vehicle identification signals, said signal level signal, and preprogrammed preemption criteria including the identity of said at least one emergency vehicle, when and in favor of which direction and for how long to preempt an intersection, said processing means delaying preemption until a sufficient number of said received vehicle identification signals of sufficient signal level have been received in a brief enough time interval from any one given vehicle of said at least one emergency vehicle to indicate that said given vehicle is at the proper distance from the intersection for preemption to commence.

2. A traffic signal preemption system in accordance with claim 1 wherein the vehicle information transmission system includes log means for maintaining a log of the time, date, and duration of all preemptions requested by the occupants of the vehicle in which the transmission system is installed.

3. A traffic signal preemption system in accordance with claim 2 wherein the direction of all requested preemptions is also maintained in the log.

4. A traffic signal preemption system in accordance with claim 1 wherein said preprogrammed preemption criteria includes priority criteria assigning priorities to vehicles and to routes, whereby higher-priority vehicles and higher-priority routes can be given preemption ahead of others.

5. A traffic signal preemption system in accordance with claim 1 wherein the vehicle detection, identification, and preemption system maintains a table of information with separate entries relating to information received from separate vehicles, including a separate entry for each of several vehicles recording the number of vehicle identification signals received from the vehicles of sufficient strength, whereby the detection, identification, and preemption system can intelligently manage multiple vehicles approaching an intersection.

6. A traffic signal preemption system in accordance with claim 1 wherein the vehicle detection, identification, and preemption system includes log means for maintaining a log of the time, date, duration, and vehicle identity associated with all preemptions of the intersection.

7. A traffic signal preemption system in accordance with claim 6 wherein the direction of all requested preemptions is also maintained in the log.

8. A traffic signal preemption system in accordance with claim 1 wherein the vehicle detection, identification, and preemption system maintains a table of information with separate entries relating to information received from vehicles approaching an intersection from separate directions, including a separate entry recording the number of vehicle identification signals received from vehicles approaching from each direction of sufficient strength, where by the detection, identification, and preemption system can intelligently manage multiple vehicles approaching an intersection from separate directions.

9. A traffic signal preemption system in accordance with claim 1 which further includes portable, detachable control panel and central data base means for feeding information including vehicle identity information and preset direction information corresponding to vehicle identity information into said vehicle detection, identification, and preemption system, which present direction information enables said vehicle detection, identification, and preemption system to determine, upon receipt of vehicle identity information from a given vehicle, from which present direction said given vehicle may be approaching an intersection.

10. A traffic signal preemption system as in claims 2, 3, 6, or 7, which further includes portable, detachable control panel and central data base means for accepting information from the log when connected to a system that maintains a log, whereby the logged information can be collected and utilized, said portable, detachable control panel and central data base means and said systems that maintain a log each including detachable I/O connector means for connecting and later disconnecting said portable, detachable control panel and central data base means to and from said systems that maintain a log.

11. A traffic signal preemption system in accordance with claim 1 wherein the vehicle information transmission system includes directional switches which, when actuated by the vehicle occupants, cause the vehicle identification signal to contain information identifying the direction from which the vehicle is approaching the intersection, and wherein said directional information enables the vehicle detection, identification, and preemption system to determine the direction from which the vehicle is approaching the intersection.

12. A traffic signal preemption system in accordance with claim 11 wherein the vehicle transmission system includes at least one preset switch which, when actuated by the vehicle occupants, cause the vehicle identification signal to contain information identifying the preset route over which the vehicle is travelling, and wherein said preset route information enables the vehicle detection, identification information stored within said vehicle detection, identification, and preemption system, to determine the direction from which the vehicle is approaching the intersection.

13. A traffic signal preemption system in accordance with claim 1 wherein the vehicle transmission system includes at least one preset switch which, when actuated by the vehicle occupants, causes the vehicle identification signal to contain information identifying the present route over which the vehicle is travelling, and wherein said preset route information enables the vehicle detection, identification, and preemption system, by reference to preset direction, identification stored, and within said vehicle detection, identification preemption system, to determine the direction from which the vehicle is approaching the intersection.

14. A traffic signal preemption system in accordance with claim 1 which further includes portable, detachable control panel and central data base means for feeding information including vehicle identification information into said vehicle transmission system, said portable, detachable control panel and central data base means and said vehicle transmission system each including detachable I/O connector means for connecting and later disconnecting said portable control panel and central data base means to and from said vehicle transmission system.

15. A traffic signal preemption system in accordance with claim 14 in which the portable, detachable control panel and central data base means can also feed a security code into said vehicle transmission system, and wherein said vehicle transmission system includes means for preventing the transmission of any signals until said security code has been entered by the occupants of the vehicle.

16. A traffic signal preemption system for enabling emergency vehicles to cause a traffic light controller at an intersection to preempt traffic signals at the intersection, causing them to signal green for an emergency vehicle and red for other directions, said system comprising:

a vehicle information transmission system installed in said emergency vehicle and including directional transmission means actuatable by the vehicle's occupants for generating information identifying said emergency vehicle and for repeatedly transmitting said information as a vehicle identification signal in the direction of vehicular motion at periodic intervals whose durations are varied to avoid frequent simultaneous generations and transmissions by plural emergency vehicles entering the same intersection; and a vehicle detection, identification, and preemption system connecting to said traffic light controller and including radio signal receiving means for receiving vehicle identification signals from one or more of said transmission systems, for extracting information identifying the emergency vehicle therefrom, and for determining, based upon preprogrammed preemption criteria including the identity of the vehicles, when and in favor of which direction and for how long to preempt an intersection;

which traffic signal preemption system further includes portable control panel and central data base means for feeding information including vehicle identification information and transmit timeout information into said vehicle transmission system.

17. A traffic signal preemption system in accordance with claim 16 in which the portable control panel and central data base means can also feed a security code into said vehicle transmission system.

18. A traffic signal preemption system for enabling emergency vehicles to cause a traffic light controller at an intersection to preempt traffic signals at the intersection, causing them to signal green for an emergency vehicle and red for other directions, said system comprising:

a vehicle information transmission system installed in said emergency vehicle and including directional transmission means actuatable by the vehicle's occupants for generating information identifying said emergency vehicle and for repeatedly transmitting said information as a vehicle identification signal in the direction of vehicular motion at periodic intervals whose durations are varied to avoid frequent simultaneous generations and transmissions by plural emergency vehicles entering the same intersection; and a vehicle detection, identification, and preemption system connecting to said traffic light controller and including radio signal receiving means for receiving vehicle identification signals from one or more of said transmission systems, for extracting information identifying the emergency vehicle therefrom, and for determining, based upon preprogrammed preemption criteria including the identity of the vehicles, when and in favor of which direction and for how long to preempt an intersection;

said vehicle detection, identification, and preemption system further including lock out means for locking out preemptions in favor of a particular vehicle or direction for a predetermined time interval following a preemption in favor of that vehicle or direction to avoid accidental multiple successive preemptions in favor of the same vehicle.

19. A traffic signal preemption system for enabling emergency vehicles to cause a traffic light controller at an intersection to preempt traffic signals at the intersection, causing them to signal green for an emergency vehicle and red for other directions, said system comprising:

a vehicle information transmission system installed in said emergency vehicle and including directional transmission means actuatable by the vehicle's occupants for generating information identifying said emergency vehicle and for repeatedly transmitting said information as a vehicle identification signal in the direction of vehicular motion at periodic intervals whose durations are varied to avoid frequent simultaneous generations and transmissions by plural emergency vehicles entering the same intersection, and a vehicle detection, identification, and preemption system connecting to said traffic light controller and including radio signal receiving means for receiving vehicle identification signals from one or more of said transmission systems, for extracting information identifying the emergency vehicle therefrom, and for determining, based upon preprogrammed preemption criteria including the identity of the vehicles, when and in favor of which direction and for how long to preempt an intersection;

wherein said vehicle detection, identification, and preemption system must receive a predetermined number of vehicle identification signals from a given vehicle within a predetermined time interval before it will initiate a preemption in favor of that vehicle.

20. A traffic signal preemption system for enabling emergency vehicles to cause a traffic light controller at an intersection to preempt traffic signals at the intersection, causing them to signal green for an emergency vehicle and red for other directions, said system comprising:

a vehicle information transmission system installed in said emergency vehicle and including directional transmission means actuatable by the vehicle's occupants for generating information identifying said emergency vehicle and for repeatedly transmitting said information as a vehicle identification signal in the direction of vehicular motion at periodic intervals whose durations are varied to avoid frequent simultaneous generations and transmission by plural emergency vehicles entering the same intersection; and a vehicle detection, identification, and preemption system connecting to said traffic light controller and including radio signal receiving means for receiving vehicle identification signals from one or more of said transmission systems, for extracting information identifying the emergency vehicle therefrom, and for determining, based upon preprogrammed preemption criteria including the identity of the vehicles, when and in favor of which direction and for how long to preempt an intersection;

wherein said vehicle detection, identification, and preemption system must receive a predetermined number of vehicle identification signals of a predetermined minimum strength before it will initiate a preemption in favor of that vehicle.

21. A traffic signal preemption system for enabling emergency vehicles to cause a traffic light controller at an intersection to preempt traffic signals at the intersection, said system comprising:

a vehicle information transmission system installed in at least one emergency vehicle and including directional transmission means actuatable by the vehicle's occupants for generating information identifying said emergency vehicle and for repeatedly transmitting said information as a vehicle identification signal in the direction of vehicular motion;

a vehicle detection, identification, and preemption system connecting to at least one traffic light controller and including radio signal receiving means for receiving vehicle identification signals from one or more of said transmission systems, for extracting information identifying the emergency vehicle therefrom, and for determining, based upon preprogrammed preemption criteria including the identity of the vehicles, when and in favor of which direction and for how long to preempt an intersection;

wherein said vehicle detection, identification, and preemption system contains intersection entry direction information for each of said at least one emergency vehicles, which information is stored within each said vehicle detection, identification, and preemption system;

and wherein this intersection entry direction information enables said vehicle detection, identification, and preemption a system to determine the direction from which a given vehicle is approaching the intersection.

22. A traffic signal preemption system for enabling emergency vehicles to cause a traffic light controller at an intersection to preempt traffic signals at the intersection, said system comprising:

a vehicle information transmission system installed in said emergency vehicle and including directional transmission means actuatable by the vehicle's occupants for generating information identifying said emergency vehicle and for repeatedly transmitting said information as a vehicle identification signal in the direction of vehicular motion, said directional transmission means including a transmitting antenna mounted upon said vehicle and transmitting radio signals beamed sufficiently in the direction of travel of said vehicle to minimize the likelihood of causing a preemption of an intersection to the side or rear of the vehicle;

a vehicle detection, identification, and preemption system connecting to said traffic light controller, said detection, identification, and preemption system including radio signal receiving means for receiving vehicle identification signals from one or more of said transmission systems and for extracting information identifying the emergency vehicle therefrom, said radio receiving means including gain control means for producing a signal level signal indicative of the strength of said vehicle identification signals, and processing means for determining, based upon said received vehicle identification signals, said signal level signal, and preprogrammed preemption criteria including the identity of the vehicles, when and for how long to preempt an intersection.

23. A traffic signal preemption system in accordance with claim 22 wherein said transmitting antenna comprises:

a hollow, directional antenna structure having an inside surface, said antenna structure mounted upon said emergency vehicle and arranged to beam said vehicle identification signal out of said hollow, directional antenna structure in the direction of vehicular travel.

24. A traffic signal preemption system in accordance with claim 23 wherein said directional antenna structure is a rectangular solid having a front rectangular surface facing in the direction of vehicular travel that is transparent to radio signals and having other rectangular surfaces that are reflective of radio signals.

25. A traffic signal preemption system in accordance with either of claims 23 and 24 wherein said directional antenna structure contains, mounted on an inside surface, at least one driven antenna stub comprising a helically wound antenna tuned to a frequency of transmission of the transmitted signals.

26. A traffic signal preemption system in accordance with either of claims 23 or 24 wherein said directional antenna structure contains, mounted on one of its inside surfaces along a line parallel to the vehicle's direction of travel and spaced one-eighth wavelength apart, at least a pair of antenna stubs each comprising a helically wound antenna, the rear-most of which stubs is tuned to the frequency of transmission and is driven, and the front-most of which stubs is tuned to a slightly higher frequency.

27. A traffic signal preemption system in accordance with any one of claims 23, 24, 25, or 26 wherein said directional antenna structure is roughly one-quarter wavelength tall by one-quarter wavelength wide.

28. A traffic preemption system in accordance with claim 22 wherein said transmitting antenna comprises a rectangular solid having a front square surface roughly one-quarter wavelength across facing in the direction of vehicle travel and transparent to radio signals and having other surfaces reflective of radio signals, and wherein said rectangular solid contains, mounted on one of its inside surfaces along a line parallel to the vehicle's direction of travel and spaced one-eighth wavelength apart, a pair of antenna stubs each comprising a helically wound antenna the rear-most of which stubs is tuned to the frequency of transmission and is driven and the front-most of which stubs is tuned to a slightly higher frequency.

* * * * *

UNITED STATES PATENT AND TRADEMARK OFFICE

CERTIFICATE OF CORRECTION

PATENT NO. : 4,914,434

DATED : April 3, 1990

INVENTOR(S) : Rodney K. MORGAN et al.

It is certified that error appears in the above-identified patent and that said Letters Patent is hereby corrected as shown below:

On the Title page, "28 Claims" should read --30 Claims-- as shown on attached sheet.

Column 1, line 49, change "(to" to --(or--.

Column 2, line 42, change "the" to --that--.

Column 3, line 11, change "receive" to --received--.

Column 3, line 22, change "determined" to --determine--.

Column 3, line 23, change "an" to --and--.

Column 3, lines 52 and 53, change "associated" to --associates--.

Column 3, line 63, change "teach" to --each--.

Column 4, line 20, change "given" to --give--.

Column 4, lines 50 and 51, change "programs" to --program--.

Column 5, line 10, change "1021" to --102--.

Column 5, line 27, after "vehicle" insert --and indicates--.

Column 6, line 11, change "present" to --preset--.

Column 6, line 22, change "n" to --in--.

Column 6, line 66, after "that" delete "at".

Column 9, line 14, change "present" to --preset--.

UNITED STATES PATENT AND TRADEMARK OFFICE

CERTIFICATE OF CORRECTION

PATENT NO. : 4,914,434

DATED : April 3, 1990

INVENTOR(S) : Rodney K. MORGAN et al.

It is certified that error appears in the above-identified patent and that said Letters Patent is hereby corrected as shown below:

Column 9, line 42, change "317" to --371--, and after "switch" insert --320--.

Column 9, line 62, change "illustrate" to --illustrates--.

Column 10, line 49, change "present" to --preset--.

Column 10, line 57, change "present" to --preset--.

Column 11, lines 6 and 7, change "transmission" to --transmissions--.

Column 12, line 21, change "ion" to --in--.

Column 12, line 42, change "504" to --604--.

Column 13, line 2, change "as" to --are--.

Column 13, line 2, change "direction" to --director--.

Column 15, line 35, change "FFG" to --FF--.

Column 16, line 9, (second occurrence) delete "preemption.".

Column 16, line 20, after "transmission" insert --system 300 or to the vehicle detection and identification--.

Column 16, line 56, after "control" insert --panel--.

Column 17, line 33, change "Step[1908" to --Step 1908--.

UNITED STATES PATENT AND TRADEMARK OFFICE

CERTIFICATE OF CORRECTION

PATENT NO. : 4,914,434

DATED : April 3, 1990

INVENTOR(S) : Rodney K. MORGAN et al

It is certified that error appears in the above-indentified patent and that said Letters Patent is hereby corrected as shown below:

Column 18, line 8, change "present" to --preset--.

IN THE CLAIMS:

Column 83, line 30, change "present" to --preset--.

Column 83, line 34, change "present" to --preset--.

Column 83, line 65, after "identification" insert --, and preemption system, by reference to preset direction--.

Column 84, line 6, change "present" to --preset--.

Column 84, line 9, after "direction" delete the comma; change "identification" to --information--; and after "stored" delete ", and".

Column 84, line 10, after "identification" insert --, and--.

Column 86, line 66, after "preemption" delete "a".

Column 88, line 10, change "and" to --or--.

Column 88, line 26, change "24, 25, or 26" to --or 24--.

UNITED STATES PATENT AND TRADEMARK OFFICE

CERTIFICATE OF CORRECTION

PATENT NO. : 4,914,434

DATED : April 3, 1990

INVENTOR(S) : Rodney K. MORGAN et al.

It is certified that error appears in the above-identified patent and that said Letters Patent is hereby corrected as shown below:

IN THE CLAIMS: (Continued)

Column 88, line 43, insert Claims 29 and 30.

--29. A traffic signal preemption system in accordance with claim 25 wherein said directional antenna structure is roughly one-quarter wavelength tall by one-quarter wavelength wide.--

--30. A traffic signal preemption system in accordance with claim 26 wherein said directional antenna structure is roughly one-quarter wavelength tall by one-quarter wavelength wide.--

Signed and Sealed this

Eighth Day of June, 1993

*Attest:*

*Attesting Officer*

Michael K. Kirk

MICHAEL K. KIRK

*Acting Commissioner of Patents and Trademarks*

United States Patent [19]

Morgan et al.

[11] Patent Number: 4,914,434

[45] Date of Patent: Apr. 3, 1990

[54] TRAFFIC SIGNAL PREEMPTION SYSTEM

[76] Inventors: Rodney K. Morgan, P.O. Box 94, Belle Rive, Jefferson County, Ill. 62810; Bradley K. Cross, P.O. Box 152, McLeansboro, Hamilton County, Ill. 62859

[21] Appl. No.: 206,172

[22] Filed: Jun. 13, 1988

[51] Int. Cl.[4] ..... G08G 1/07

[52] U.S. Cl. ..... 340/906; 340/902; 340/907

[58] Field of Search ..... 340/906, 907, 902, 916, 340/933, 935, 904; 455/99, 95, 67, 134

[56] References Cited

U.S. PATENT DOCUMENTS

| | | | |
|---|---|---|---|
| 3,257,641 | 6/1966 | Campana et al. | 340/33 |
| 3,638,179 | 1/1972 | Coll et al. | 340/32 |
| 3,886,515 | 5/1975 | Cottin et al. | 340/906 |
| 4,016,532 | 4/1977 | Rose | 340/906 |
| 4,228,419 | 10/1980 | Anderson | 340/32 |
| 4,230,992 | 10/1980 | Munkberg | 328/140 |
| 4,443,783 | 4/1984 | Mitchell | 340/32 |
| 4,573,049 | 2/1986 | Obeck | 340/906 |

FOREIGN PATENT DOCUMENTS

| | | | |
|---|---|---|---|
| 1315525 | 5/1973 | United Kingdom | 340/906 |

*Primary Examiner*—Donnie L. Crosland

*Attorney, Agent, or Firm*—Fitch, Even, Tabin & Flannery

[57] ABSTRACT

When placed into operation by the occupants of an emergency vehicle, a vehicle transmission system having a directional antenna sends out a series of UHF messages spaced apart by varying lengths of time and identifying the emergency vehicle, its priority, and its direction, or indicating that the vehicle is travelling along a pre-planned route. At each signal-controlled intersection, a vehicle detection, identification, and preemption system having an omnidirectional antenna and containing information identifying vehicles authorized to preempt the intersection and their pre-planned directions of travel receives these messages from plural vehicles and determines when and in favor of which direction and for how long the intersection is to be preempted.

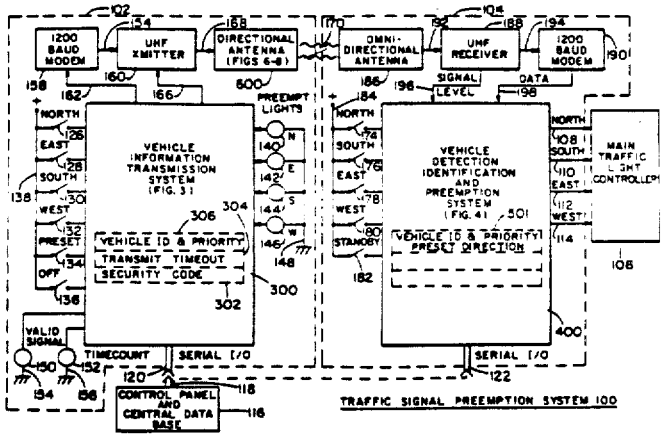

30 Claims, 18 Drawing Sheets